US007661896B2

(12) United States Patent
Zawitz

(10) Patent No.: US 7,661,896 B2
(45) Date of Patent: Feb. 16, 2010

(54) THERAPEUTIC WRITING INSTRUMENT DEVICES AND METHODS

(75) Inventor: Richard E. Zawitz, San Francisco, CA (US)

(73) Assignee: Tangle, Inc., South San Francisco, CA (US)

( * ) Notice: Subject to any disclaimer, the term of this patent is extended or adjusted under 35 U.S.C. 154(b) by 671 days.

(21) Appl. No.: 11/152,020

(22) Filed: Jun. 13, 2005

(65) Prior Publication Data

US 2006/0280545 A1 Dec. 14, 2006

(51) Int. Cl.
*A46B 5/02* (2006.01)

(52) U.S. Cl. ..... 401/6; 401/8

(58) Field of Classification Search ..... 401/6–8, 401/195, 209

See application file for complete search history.

(56) References Cited

U.S. PATENT DOCUMENTS

| | | | | |
|---|---|---|---|---|
| 153,717 | A | 8/1874 | Magerhaus | |
| 616,208 | A | 12/1898 | Stanek | |
| 913,689 | A | 3/1909 | Bullard | |
| 956,632 | A | 5/1910 | Finch | |
| 1,069,746 | A | 8/1913 | Watts | |
| 1,322,966 | A | 11/1919 | Sinclair | |
| 1,519,702 | A | 12/1924 | Preuss | |
| 1,611,488 | A | 12/1926 | Rocquin et al. | |
| 1,852,071 | A | 4/1932 | Becker | |
| 1,950,960 | A * | 3/1934 | Wisser | 401/195 |
| 2,073,346 | A | 3/1937 | Clow | |
| 2,224,470 | A | 12/1940 | Boust | |
| 2,596,688 | A | 5/1952 | Hinsen | |
| 2,662,335 | A | 12/1953 | Calverley | |
| 2,703,724 | A | 3/1955 | Der Yuen et al. | |
| 2,752,106 | A | 6/1956 | Thompson | |
| 2,959,888 | A | 11/1960 | Noble | |
| 2,992,495 | A | 7/1961 | Perreira | |
| 3,222,072 | A | 12/1965 | Dreyer | |
| 3,238,586 | A | 3/1966 | Stoffel | |
| 3,251,103 | A | 5/1966 | Saut | |

(Continued)

FOREIGN PATENT DOCUMENTS

| | | |
|---|---|---|
| DE | 2503780 | 5/1976 |

(Continued)

OTHER PUBLICATIONS

U.S. Appl. No. 10/744,962, filed Dec. 2003, Zawitz.

(Continued)

*Primary Examiner*—Tuan N Nguyen
(74) *Attorney, Agent, or Firm*—Townsend and Townsend and Crew LLP

(57) ABSTRACT

The invention provides systems and methods for a writing instrument that can be manipulated into an infinite number of shapes and configurations. The invention can be applied to relieve minor stress as well as strengthen hand muscles, rehabilitate finger and joint movement, and improve overall range of hand motion. A textured coating can be applied to the surface of each segment that gives the writing instrument a unique feel, thereby creating a pleasant sensation and feel to the hands and fingers. Segments can operate as a holder for a writing instrument body, and similarly can be arranged to provide a creative sculpture. Segments can be removed as desired by the user.

17 Claims, 33 Drawing Sheets

U.S. PATENT DOCUMENTS

| | | | | | |
|---|---|---|---|---|---|
| 3,389,493 | A | | 6/1968 | Zysset | |
| 3,469,339 | A | | 9/1969 | Thomas | |
| 3,514,893 | A | | 6/1970 | Paksy | |
| 3,581,408 | A | | 6/1971 | Mohier | |
| 3,597,872 | A | | 8/1971 | Venaela et al. | |
| 3,900,984 | A | | 8/1975 | Garelick | |
| 3,948,455 | A | | 4/1976 | Schwartz | |
| 3,963,914 | A | | 6/1976 | Browning et al. | |
| 3,977,683 | A | | 8/1976 | Tomura | |
| 4,012,155 | A | | 3/1977 | Morris | |
| 4,031,635 | A | | 6/1977 | Brandt et al. | |
| 4,062,543 | A | | 12/1977 | Loeffler | |
| 4,071,244 | A | | 1/1978 | Richards | |
| 4,106,657 | A | | 8/1978 | Dogliotti | |
| 4,162,754 | A | * | 7/1979 | Fleming | 401/195 |
| 4,180,940 | A | | 1/1980 | McMasters | |
| 4,184,271 | A | | 1/1980 | Barnett, Jr. | |
| 4,214,747 | A | | 7/1980 | Rebajes | |
| 4,232,473 | A | | 11/1980 | Jenkins | |
| 4,259,821 | A | | 4/1981 | Bush | |
| 4,305,582 | A | | 12/1981 | Barton | |
| 4,325,698 | A | | 4/1982 | Darling et al. | |
| 4,362,031 | A | | 12/1982 | Obermuller | |
| 4,377,916 | A | | 3/1983 | Komiya | |
| 4,509,929 | A | | 4/1985 | Zawitz | |
| D283,516 | S | * | 4/1986 | Huang | 401/209 |
| 4,579,538 | A | | 4/1986 | Bass et al. | |
| 4,580,919 | A | | 4/1986 | Ambasz | |
| 4,738,558 | A | | 4/1988 | Hiromori | |
| 4,778,184 | A | | 10/1988 | Fleischer | |
| 4,784,391 | A | | 11/1988 | Herron | |
| 4,867,456 | A | | 9/1989 | Weber et al. | |
| 4,872,775 | A | | 10/1989 | Chang | |
| 4,935,995 | A | | 6/1990 | Daus, Jr. | |
| 5,018,252 | A | | 5/1991 | Butler | |
| 5,024,547 | A | | 6/1991 | Mui et al. | |
| 5,110,315 | A | | 5/1992 | Zawitz | |
| 5,143,465 | A | | 9/1992 | Hou | |
| 5,158,384 | A | | 10/1992 | Radmilovic et al. | |
| 5,172,534 | A | | 12/1992 | Milner | |
| 5,308,179 | A | | 5/1994 | Whitright | |
| 5,527,124 | A | | 6/1996 | Kolaric | |
| 5,584,195 | A | * | 12/1996 | Liu | 401/6 |
| 5,897,417 | A | | 4/1999 | Grey | |
| 6,086,445 | A | | 7/2000 | Zawitz | |
| 6,637,962 | B1 | | 10/2003 | Roche et al. | |

FOREIGN PATENT DOCUMENTS

| | | |
|---|---|---|
| FR | 1195407 | 11/1959 |
| WO | WO 87/00070 | 1/1987 |

OTHER PUBLICATIONS

U.S. Appl. No. 11/015,387, filed Dec. 2004, Zawitz.

Thompson, Jonathan. The Versatility of Vision. *World Sculpture News*, vol. 11, No. 1 (Winter 2005), pp. 32-35.

* cited by examiner

THERAPEUTIC WRITING INSTRUMENT DEVICES AND METHODS

CROSS-REFERENCES TO RELATED APPLICATIONS

This application is related to U.S. Pat. Nos. 4,509,929, 5,110,315, and 6,086,445 and to U.S. patent application Ser. No. 10/744,962, filed Dec. 23, 2003, and Ser. No. 11/015,387, filed Dec. 16, 2004, the entire disclosures of which are herein incorporated by reference for all purposes.

STATEMENT AS TO RIGHTS TO INVENTIONS MADE UNDER FEDERALLY SPONSORED RESEARCH OR DEVELOPMENT

Not Applicable

REFERENCE TO A "SEQUENCE LISTING," A TABLE, OR A COMPUTER PROGRAM LISTING APPENDIX SUBMITTED ON A COMPACT DISK

Not Applicable

BACKGROUND OF THE INVENTION

This invention relates generally to the field of writing instruments, and more particularly to writing instruments that include decorative, therapeutic, and other functional accessories.

Stresses, injuries and health issues are an everyday part of life. In today's fast-paced, hectic world, stress-related illnesses and injuries are more prevalent than the common cold. We all face it, but how we deal with it makes the difference between being healthy and being sick. The hands are particularly sensitive to the many stresses associated with daily life. However, the hands are also a major source of stress relief. Aromatherapy lotions, hand massages, and squishy stress relief figures assist in relieving overall stress and may provide a small degree of strengthening and conditioning to the hand, fingers and joints.

In addition to stress, people with musculoskeletal impairment of the hand and wrist are subject to loss of basic manipulative functions essential to carrying out daily activities. Such a loss can be disheartening, debilitating, and sometimes incapacitating since it may lead to the reliance on the assistance and care from others. Studies have shown that clinically controlled exercise is important for restoring or maintaining hand function. While it is possible to motivate patients in a clinical environment to do hand exercises, long-term post-clinical enforcement of a therapeutic program is rarely achieved.

Hence, there is a need for writing instruments that are manipulated by the hand and fingers for improving and rehabilitating hand and finger muscle performance, restoring joint and range of hand motion while at the same time providing both stress relief and hours of enjoyment. It is desirable to provide such writing instruments that may be manipulated between the fingers and the palm to provide relief from daily stresses as well as strengthening and conditioning for rehabilitating and preventing minor injuries to the hand, fingers and wrist. Such writing instruments would provide hours of enjoyment and therapeutic aid by keeping the brain engaged, stimulated, and interested in a textured instrument that can be twisted into a multitude of patterns, shapes, and textures. These instruments are also valuable to the user as a manual diversion tranquilizer, as hand motion combined with an activity that requires low attention has a canning effect on the mind. Further, the fluid nature and aesthetic appearance of such writing instruments can provide the user with a meditative focus.

BRIEF SUMMARY OF THE INVENTION

In a broad sense, the invention provides various writing instruments that, in addition to providing a writing function, provide accessories that may be manipulated with one or both hands. Relatedly, the present invention provides useful shapes and configurations that allow a user to efficiently and ergonomically grip and handle the instrument. The instruments can be constructed of multiple segments or links that are connected and may be twisted or turned relative to each other. One aspect of the invention is the therapeutic benefits provided by the writing instruments. Such benefits include, but are in no way limited to, helping strengthen or rehabilitate the fingers, hands, or forearms, as well as relieving stress and providing relaxation, among others. Advantageously, the present invention can be embodied in a wide variety of writing instrument modalities, including ball point pens, retractable pens, pencils, colored pencils, charcoal pencils, mechanical pencils, fountain pens, dip pens, quill pens, paint brushes, gel pens, markers, highlighters, stylographs, crayons, and the like.

To provide such benefits, the writing instrument segments may be provided with a wide variety of therapeutic elements. Such therapeutic elements may include resilient coatings, rotatable or slidable elements on the surface of the segments, heating or cooling of the segments, vibratable elements, encased gels or liquids, various textured surfaces, colors and/or lights, varying sizes, thicknesses and/or levels of resilience, therapeutic magnets, surfaces that move up and down or in and out, various natural or synthetic materials, such as fabrics, leather, features, fibers, seeds, other plants and the like, scented materials, herbs, flavored materials, sticky surfaces, raised or lowered images (including brail), lotions, ointments, medicines, lubricants, sponges, porous materials, foams, rubbers, bendable tabs, extensions, spikes, clays or putty, electrical stimulation elements, and the like.

Often, the segments or links can be operated as a holder for a writing instrument body. For example, the segments may be sculpted and configured by the user in a variety of locations when sitting on a desk. In some cases, the segments can be arranged so as to prop the writing instrument body at an angle, disposed above the desk. Alternatively, the segments can be arranged so as to support the writing instrument body in a horizontal position on the desk. This feature allows the user to devise a creative sculpture when the writing instrument sits on the desk or other desk accessory such as a computer or phone. Similarly, a creative sculpture can be made when using the writing instrument to write. In related cases, the segments will be easily removable so that if the user does not want the segments on the writing instrument body while writing, he or she can simply pull them off or otherwise disconnect them. In another instance, the user can arrange the segments so as to form a loop that can be placed around the wrist, or hung from a hook.

In one specific embodiment, the invention provides both methods and apparatus for a texture coated therapeutic writing instrument for hand, mind and overall wellness of being. The applications for such a textured twisting stress reliever are many, ranging from recreation for children and adults to strengthening and rehabilitation for individuals with therapeutic needs. The texture coating on the therapeutic writing instrument can be soothing and gentle to the touch, and can provide the user an improved feel over typical non-coated materials such as plastic. As a result, the therapeutic value of the writing instrument is enhanced due to an increase in the length of time the instrument is used or held in the hand. Hence, the writing instruments of the invention may be used to assist with a variety of ailments, such as smoking cessation or other habits, to assist those suffering from hand ailments, such as arthritis, carpel tunnel syndrome, and the like, and to assist with developing muscle tone in the hand, among others.

In a first aspect, the present invention provides a writing instrument. The writing instrument can include a writing instrument body having a first junction, a second junction, and a writing element; and a plurality of serially pivotally connected segments, the plurality of segments including at least a first segment and a second segment. The first junction can be connected with the first segment and the second junction can be connected with the second segment. In a related aspect, the first junction can be disposed toward a first end of the writing instrument body. Similarly, the second junction can be disposed toward a second end of the writing instrument body. In some aspects, the first segment can be disposed toward a first end of the plurality of pivotally connected segments. Similarly, the second segment can be disposed toward a second end of the plurality of pivotally connected segments.

In one aspect, each of the plurality of serially pivotally connected segments can be twistable relative to an adjacent segment through a 360 degree of rotation. Each of the plurality of serially pivotally connected segments can include a torus curve. In related aspects, each of the plurality of serially pivotally connected segments can have a textured coating disposed on an outer surface thereof. The textured coating can include a rubber coating, a rubber coating with raised nodules, a silicone gel coating, a chemical composite coating, or a compressible rubber coating. In some aspects, the first junction can be releasably connected with the first segment and the second junction can be releasably connected with the second segment.

In another aspect, the present invention provides a method of manufacturing a writing instrument. The method can include coupling a writing element with a writing instrument body, the writing instrument body having a first junction and a second junction; coupling a first segment of a plurality of serially pivotally connected segments to the first junction; and coupling a second segment of the plurality of serially pivotally connected segments to the second junction. The method may also include fixing a textured coating on an outer surface of each of the plurality of serially pivotally connected segments. In some aspects, the method may include releasably connecting the first junction with the first segment and releasably connecting the second junction with the second segment.

In yet another aspect, the present invention provides a therapeutic writing instrument that includes a writing instrument body, a plurality of serially pivotally connected segments, and a therapeutic element. The writing instrument body can have a first junction, a second junction, and a writing element. The plurality of serially pivotally connected segments can have at least a first segment and a second segment. The therapeutic element can be coupled with at least one of the plurality of segments to provide a therapeutic treatment to a user. The first junction can be connected with the first segment and the second junction can be connected with the second segment.

For a fuller understanding of the nature and advantages of the present invention, reference should be had to the ensuing detailed description taken in conjunction with the accompanying drawings.

BRIEF DESCRIPTION OF THE DRAWINGS

FIG. 1O illustrates a tenth embodiment of a writing instrument in accordance with the present invention.

DETAILED DESCRIPTION OF THE INVENTION

Figure 1A:
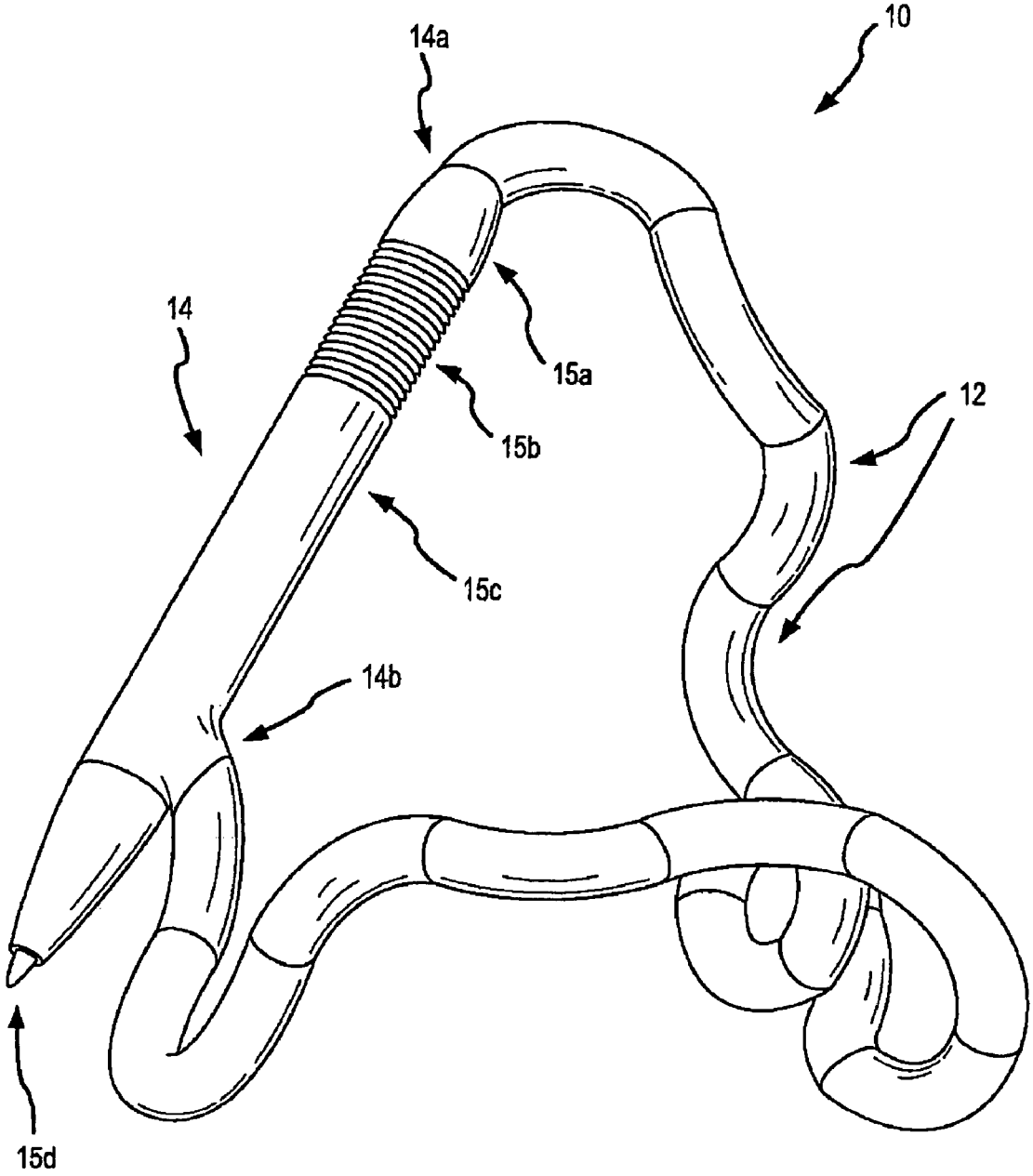
FIG. 1A illustrates a first embodiment of a writing instrument in accordance with the present invention.

One aspect of the invention provides a therapeutic writing instrument that can be manipulated into an infinite number of shapes and configurations. The invention can be applied to relieve minor stress as well as strengthen hand muscles, rehabilitate finger and joint movement and improve overall range of hand motion. In use, the resulting instrument provides hours of use and enjoyment, thereby increasing the effectiveness of the numerous therapeutic benefits. The textured instrument may be manufactured in a variety of colors, shapes, and textures that are sized for children as well as adults.

Certain advantages of the invention can be achieved by applying a material, substance or device to the surface of one or more of the segments. The surface application can provide a unique feel to the therapeutic writing instrument, creating a unique sensation and feel to the user's hands and fingers. In addition, modifying the surface of the segments may reduce hand fatigue, thus allowing the user to manipulate the writing instrument for longer periods of time. Other features include helping with smoking cessation or other habits, assisting those suffering from hand and wrist ailments, such as arthritis, carpel tunnel syndrome, and the like, and contributing to muscle tone development and hand and finger dexterity. Further, the writing instrument may help relieve minor stresses, increase range of hand motion, improve muscle performance and rehabilitate hand muscles and joints. Also, substances, textures or temperature variations may be provided directly to the user's hands and fingers. Hence, the writing instrument facilitates hand, mind and overall well being.

A wide variety of materials or devices may be associated with the therapeutic writing instrument segments to provide various healing and restorative effects. As one example, various coatings or coverings may be provided on the surface of the segments. The coatings or coverings may have various levels of rigidity, firmness, flexibility, softness, pliability, textures and the like. For instance, the covering may comprise a resilient material, such as rubber, foam, sponge, elastomer, urethane or similar material. These pliant materials may have a wide range of firmness levels, such as an IFD (Indention Force Deflection), to provide the writing instrument with different "feel" based on the covering. Another approach to varying the firmness of the writing instrument segment utilizes a covering that includes an encapsulated gel or liquid. The covering may also be a malleable material, such as clay, putty or playdough.

The individual segments may incorporate a variety of textures. For example, the segment surface may include various knobs, detents, bumps, ridges, ribs or the like that provide a distinct sensation as the user runs their fingers across the surface of the writing instrument. Other textures include bendable or flexible tabs, extensions, posts, rubber spikes or the like. The segments may also include raised or recessed images, such as letters, characters, numbers, brail or the like. As a further example, the surface may be rough, smooth, slippery, tacky, sticky, lubricated or the like.

In some embodiments, the segments may include various natural or synthetic materials. For instance, the surface could include seeds, dried fruits or plants, feathers, leather, wood grains, fibers, hairs or the like. The surface may also include scented materials useful in aromatherapy, such as herbs, flowers, or even flavored substances.

The writing instrument segments may also include materials such as lotions, oils, ointments or lubricants that may be transferred to the user's hands. In some cases, the segments may include a medicament that contacts the user's hands, such as an arthritis ointment, medicated hand cream, antibiotic or the like.

In other embodiments, various moveable, slidable, depressible or rotatable elements or devices may be arranged on or about individual segments. As one example, a rotatable sleeve or cylinder may be placed about the segments. As another example, a segment may include slidable tabs or other elements that move horizontally or vertically relative to the surface of the instrument segment. In still another example, an instrument segment may include depressible tabs or buttons disposed on the surface of the segment.

The writing instrument segments may also be configured to move in and out, such as by encasing springs on the outer surface. Also, the segments could be configured to vibrate by incorporating one or more vibratable elements on or below the surface, such as a piezoelectric, ceramic or mechanical vibrator. The segments could also be used to provide electrotherapy by producing mild electrical shocks. The electrotherapy energy may be provided by one or more batteries, either included within the segments or as an external battery pack. Also, heating or cooling elements could be provided to heat or cool the segments. Examples of heaters or coolers include Peltier devices.

Each segment that, in combination with other segments, forms the writing instrument may incorporate an identical coating or texture, dissimilar coatings or textures, or any combination thereof. For example, a twenty segment writing instrument may be constructed of twenty feather coated segments. Alternatively, a twenty segment instrument may be formed by twenty individual segments, each one having a different coating and/or texture. Since any number of combinations in between is possible, the twenty segment writing instrument may be manufactured using an infinite number of combinations of textured and/or coated segments. In this way, the segments themselves can convey a therapeutic benefit to the user, and the auxiliary attachments, coatings, or other attachments can similarly provide a therapeutic benefit.

Another advantage of the present invention is a magnetic connector adapted for connecting adjacent segments of the therapeutic writing instrument. The magnetic connectors can allow the user to easily change out or completely remove segments to create even more shapes and configurations. In addition, the magnetic connectors may provide therapeutic benefits, such as magnetic therapy to individuals suffering from arthritis.

The segments or links can be operated as a holder for a writing instrument body. For example, the segments may be sculpted and configured by the user in a variety of locations when sitting on a desk. In some cases, the segments can be arranged so as to prop the writing instrument body at an angle, disposed above the desk. Alternatively, the segments can be arranged so as to support the writing instrument body in a horizontal position on the desk. Because the segments can be conformed to any of a variety of configurations, they can be arranged to support the writing instrument on irregular surfaces and other non-flat surfaces as well. Further, the segments allow the user to hang the writing instrument from a hook, a peg, or other similar support. This feature also allows the user to devise a creative sculpture when the writing instrument sits on the desk or other desk accessory such as a computer or phone. Similarly, a creative sculpture can be made when using the writing instrument to write. In related cases, the segments will be easily removable so that if the user does not want the segments on the writing instrument body while writing, he or she can simply pull them off or otherwise disconnect them. In another instance, the user can arrange the segments so as to form a loop that can be placed around the wrist to be worn as a bracelet, or around the neck to be worn as a necklace.

Referring now to the drawings, the systems and methods of the invention will be described in detail. Referring first to FIG. 1A, an example of a writing instrument 10 in accordance with one embodiment of the present invention will be described. Writing instrument 10 includes a plurality of rotatably coupled links 12, or serially pivotally connected segments, that can be interchangeable with one another. Links 12 can be connected end-to-end to a writing instrument body 14, at junctions 14*a* and 14*b*, to form a ring. In some embodiments, at least one of the junctions, for example junction 14*a*, can be made to be slidable or adjustable in position along at least part of the length of writing instrument body 14. The links may be constructed of wood, plastic, composites, metals or the like. Exemplary techniques for constructing and connecting such links are described in, for example, previously incorporated U.S. Pat. Nos. 4,509,929, 5,110,315, and 6,086,445 and U.S. patent application Ser. No. 10/744,962, filed Dec. 23, 2003, and Ser. No. 11/015,387, filed Dec. 16, 2004.

As noted above, the present invention can be embodied in a various types of writing instrument modalities, including retractable ball point pens and mechanical pencils. In some case, writing instrument body 14 can include a spring-loaded push button 15*a*, a compressible sleeve 15*b*, a container 15*c*, and a writing element 15*d*. By repeatedly pressing push button 15*a* toward container 15*c* and thereby compressing sleeve 15*b*, a user can toggle the configuration of writing element between an advanced orientation in which the user can write with the instrument, and a retracted orientation in which the user cannot write with the instrument.

Figure 1B:
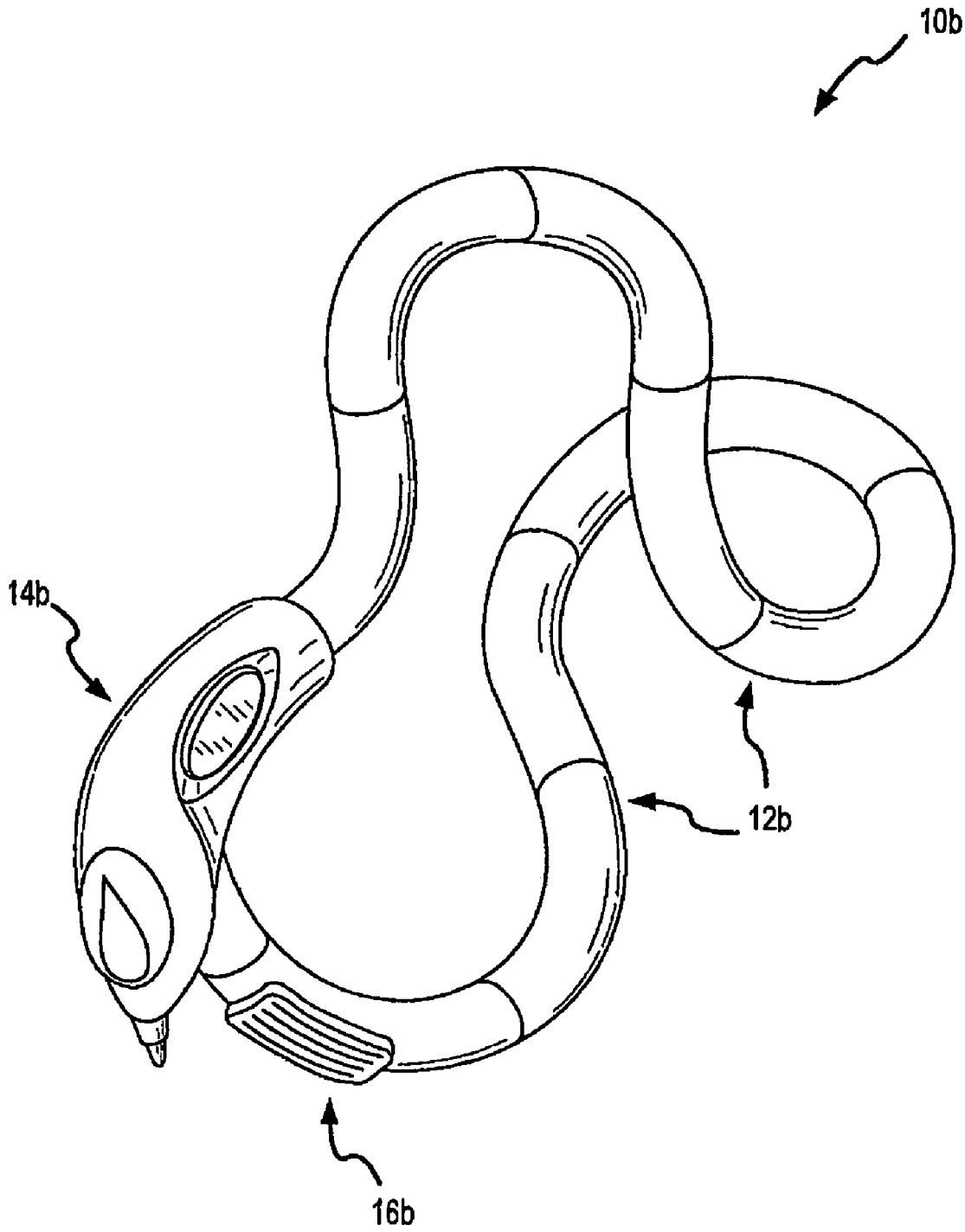
FIG. 1B illustrates a second embodiment of a writing instrument in accordance with the present invention.

FIG. 1B illustrates a writing instrument 10*b* according to one embodiment of the present invention. Writing instrument 10*b* includes a plurality of rotatably coupled links 12*b* that can be interchangeable with one another. Links 12*b* can be connected together and with a writing instrument body 14*b* as described above. Instrument 10*b* also includes a light 16*b* for illuminating a writing surface.

Figure 1C:
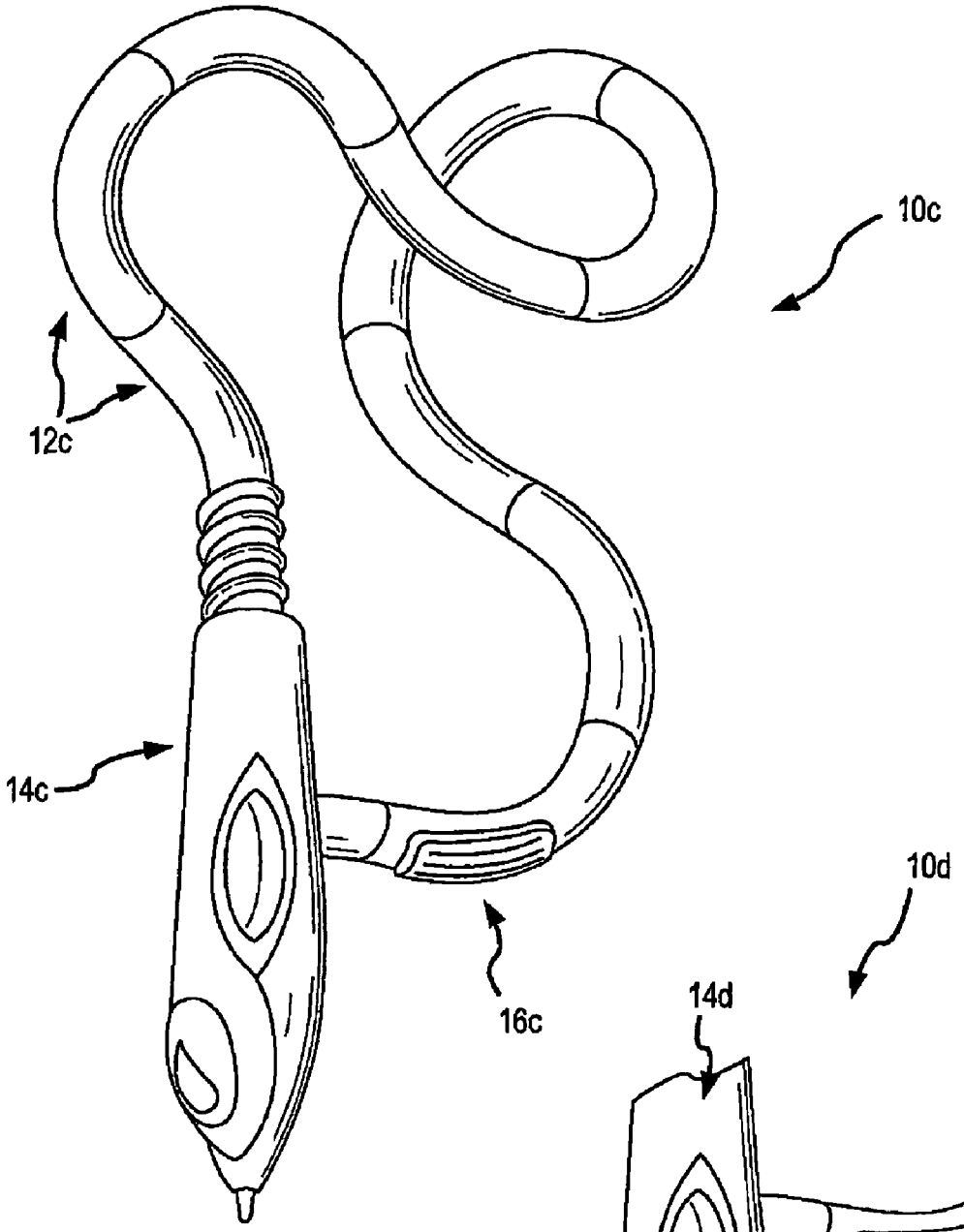
FIGS. 1C and 1D illustrate a third embodiment of a writing instrument in accordance with the present invention.
Figure 1D:
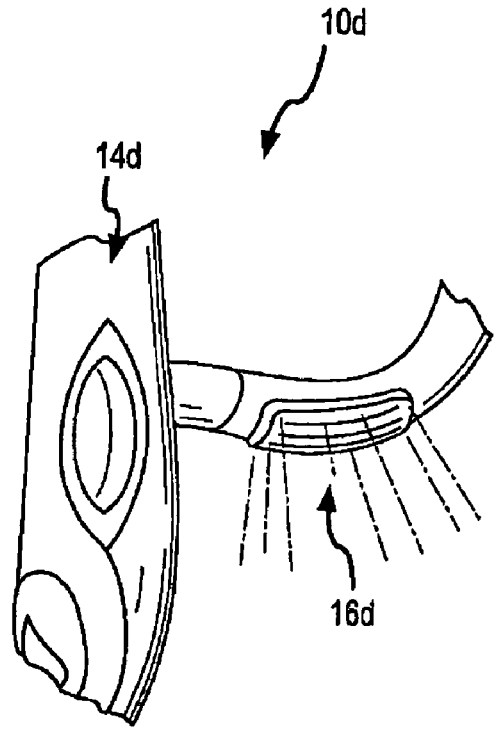

FIG. 1C illustrates a writing instrument 10*c* according to one embodiment of the present invention. Writing instrument 10*c* includes a plurality of rotatably coupled links 12*c* that can be interchangeable with one another. Links 12*c* can be connected together and with a writing instrument body 14*c* as described above. Instrument 10*c* also includes a light 16*c* for illuminating a writing surface. FIG. 1D provides an illustration of writing instrument 10*d*, having writing instrument body 14*d*, and light 16*d*, wherein light 16*d* is illuminated.

Figure 1E:
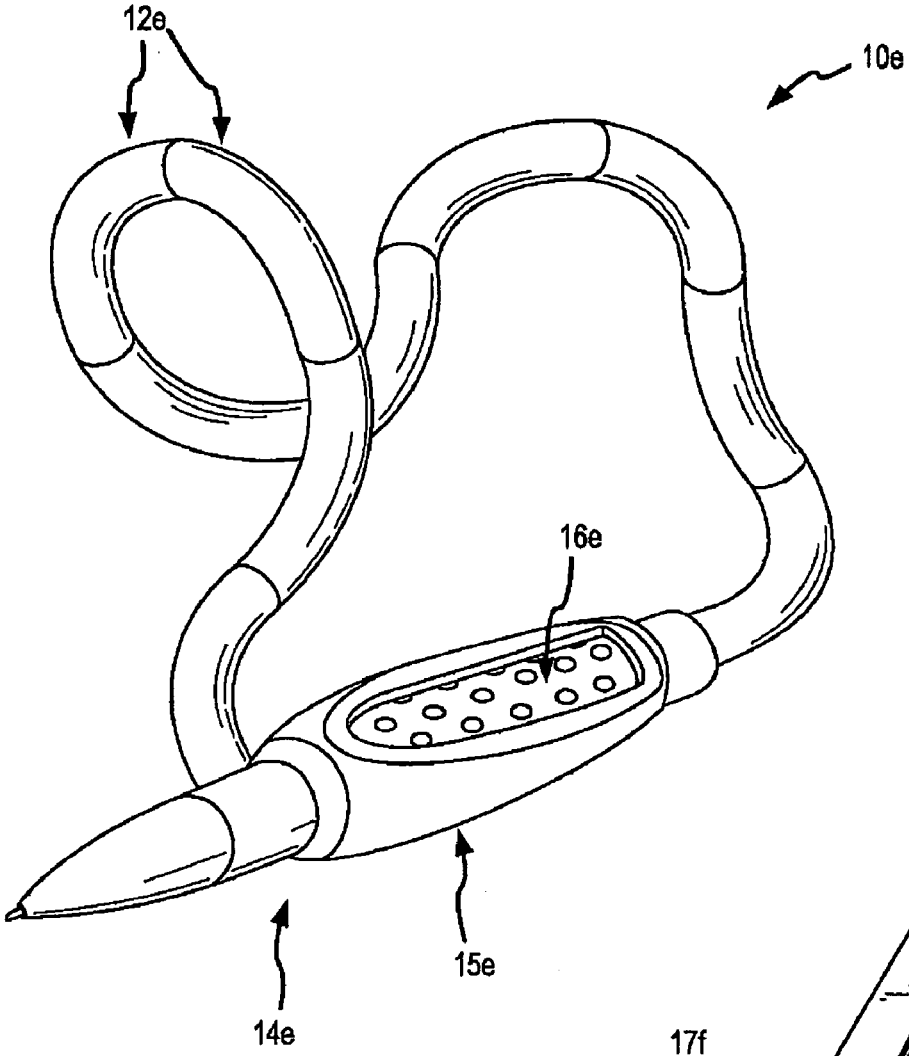
FIGS. 1E and 1F illustrate a fourth embodiment of a writing instrument in accordance with the present invention.
Figure 1F:
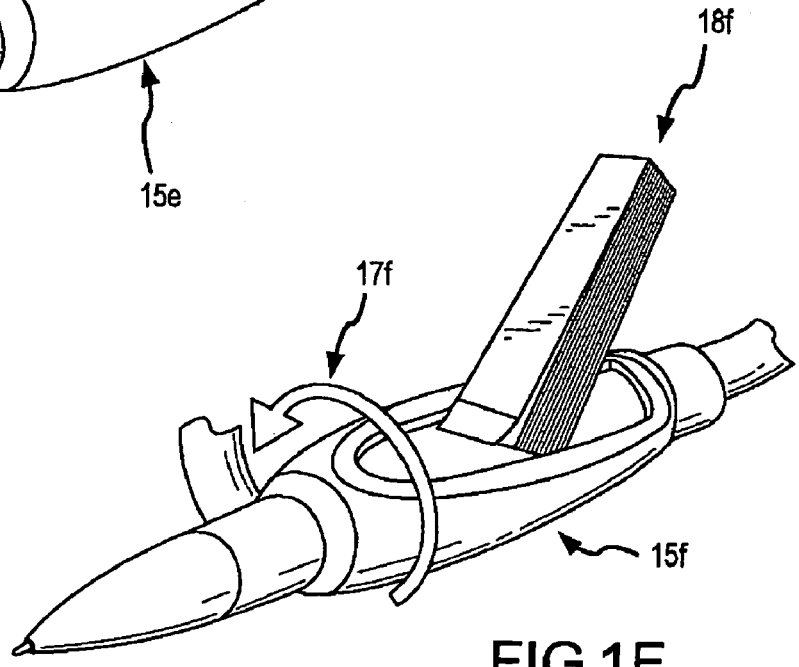

FIG. 1E illustrates a writing instrument 10*e* according to one embodiment of the present invention. Writing instrument 10*e* includes a plurality of rotatably coupled links 12*e* that can be interchangeable with one another. Links 12*e* can be connected together and with a writing instrument body 14*e* as described above. Instrument body 14*e* also includes a housing 15*e* defining an enclosure which is adapted to receive at least one article. Instrument body 14*e* may also include a housing cover 16*e*. FIG. 1F shows that housing 15*f* and housing cover (not shown) can be rotatable relative to each other, as indicated by arrow 17*f*. In this way, writing instrument can adopt a closed configuration as in FIG. 1E or an open configuration as in FIG. 1F. When in the open position, housing 15*f* provides an opening that allows an article such as a memo pad 18*f* to be placed in or removed from the enclosure.

Figure 1G:
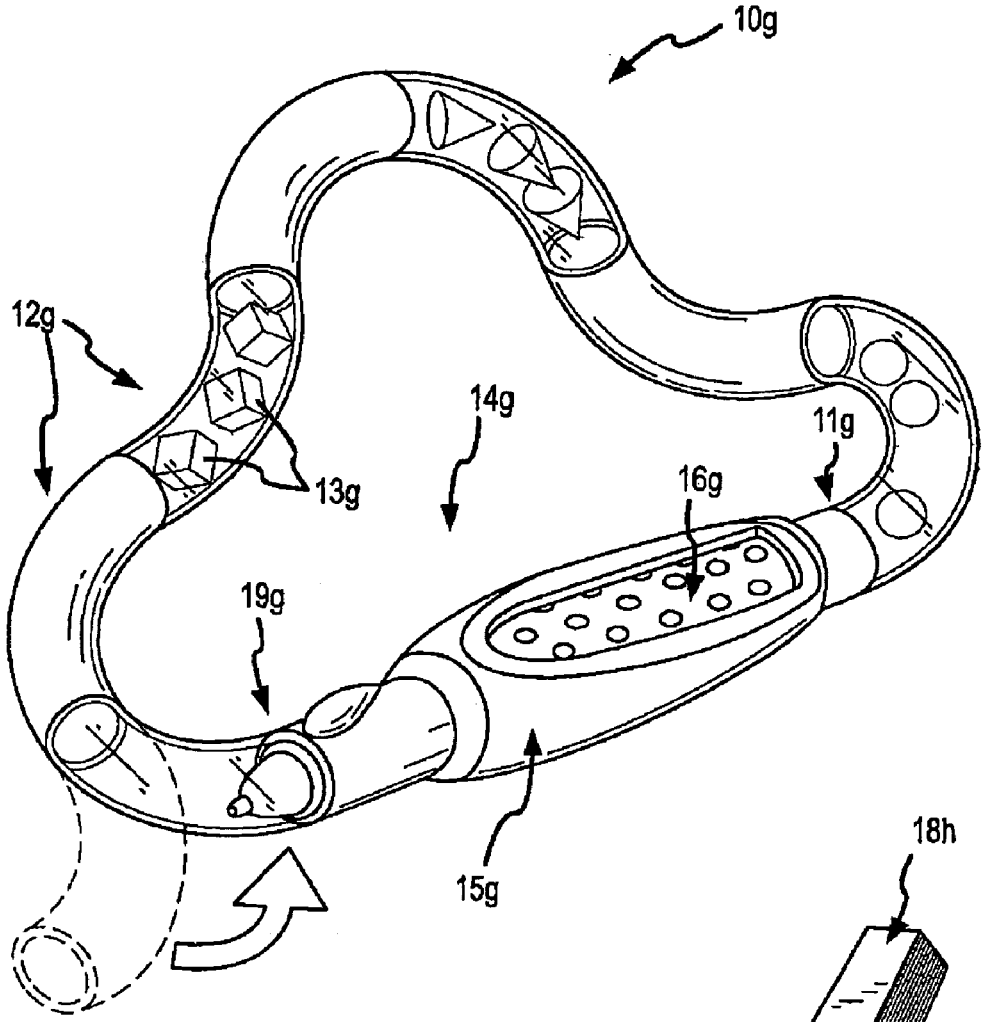
FIGS. 1G and 1H illustrate a fifth embodiment of a writing instrument in accordance with the present invention.
Figure 1H:
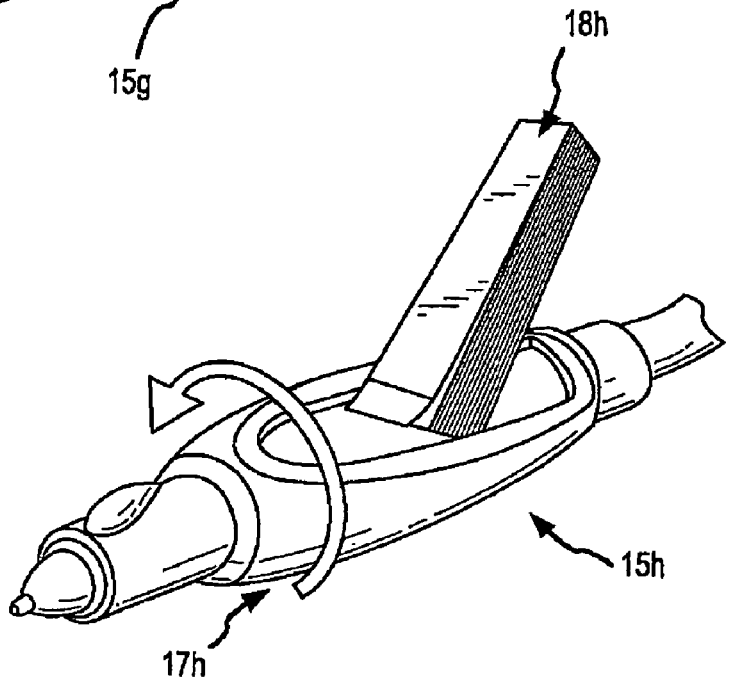

FIG. 1G illustrates a writing instrument 10*g* according to one embodiment of the present invention. Writing instrument 10*g* includes a plurality of rotatably coupled links 12*g* that can be interchangeable with one another. Links 12*g* can be connected together and with a writing instrument body 14*g* as described above. Links 12*g* can be constructed of a transparent material, and can contain items within the body of the link. As seen here, such items may include cubes, cones, and spheres. Links 12*g* can be connected end-to-end to writing instrument body 14*g*, at junctions 11*g* and 19*g*, to form a ring. In the embodiment depicted here, junction 19*g* allows link 12*g* to be releasably coupled with instrument body 14*g*, effectively providing a cap for the writing instrument. Instrument body 14*g* also includes a housing 15*g* defining an enclosure which is adapted to receive at least one article. Instrument body 14*g* may also include a housing cover 16*g*. FIG. 1H shows that housing 15*h* and housing cover (not shown) can be rotatable relative to each other, as indicated by arrow 17*h*. In this way, writing instrument can adopt a closed configuration as in FIG. 1G or an open configuration as in FIG. 1H. When in the open position, housing 15*h* provides an opening that allows an article such as a memo pad 18*h* to be placed in or removed from the enclosure.

Figures 1I, 1J:
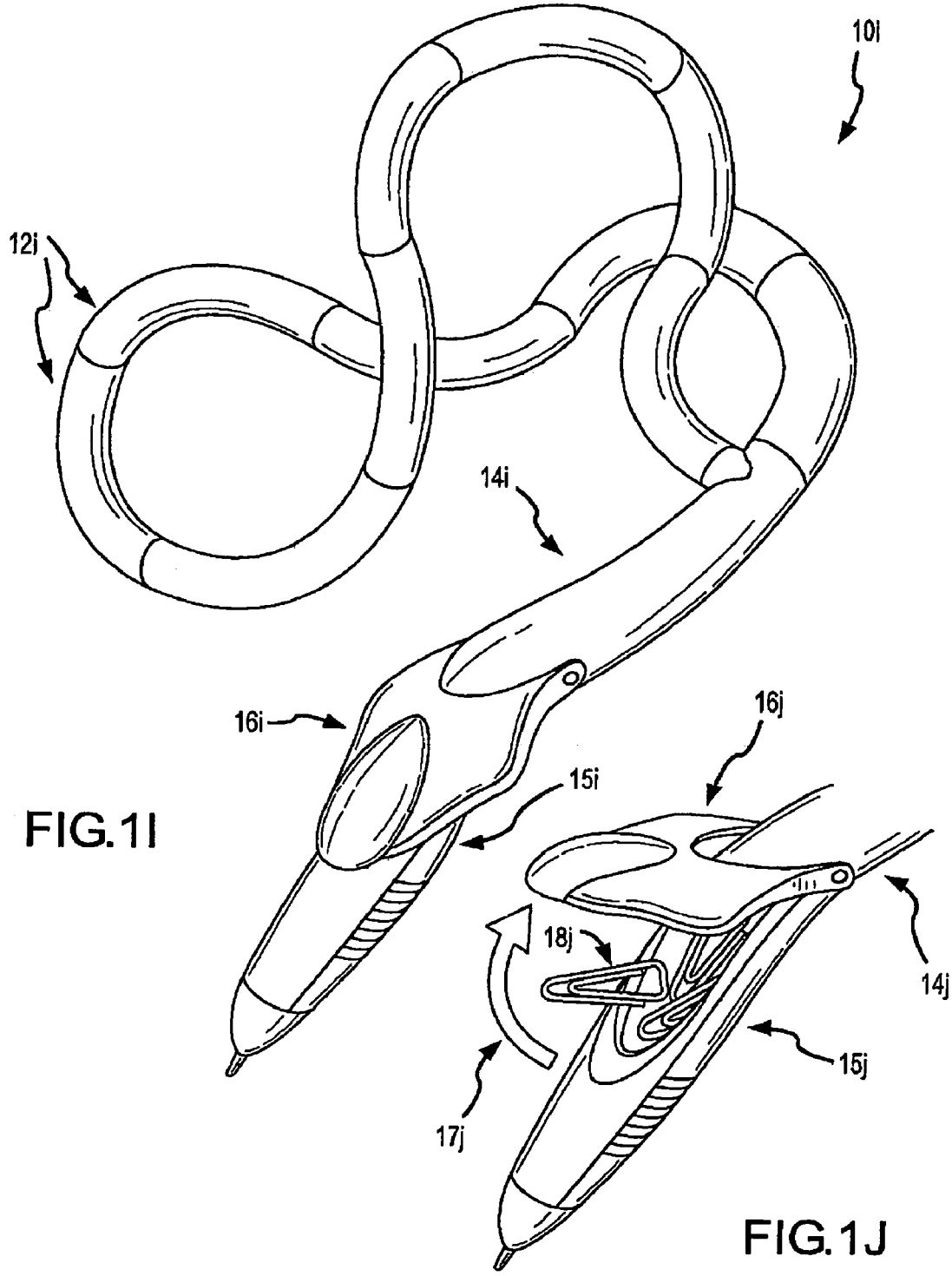
FIGS. 1I and 1J illustrate a sixth embodiment of a writing instrument in accordance with the present invention.

FIG. 1I illustrates a writing instrument 10*i* according to one embodiment of the present invention. Writing instrument 10*i* includes a plurality of rotatably coupled links 12*i* that can be interchangeable with one another. Links 12*i* can be connected together and with a writing instrument body 14*i* as described above. Instrument body 14*i* also includes a housing 15*i* defining an enclosure which is adapted to receive at least one article. As shown in FIG. 1J, instrument body 14*j* may also include a housing cover 16*j*, such that housing cover 16*j* and housing 15*j* and/or instrument body 14*j* are in hinged cooperation each other, as indicated by arrow 17*j*. In this way, the writing instrument can adopt a closed configuration as in FIG. 1I or an open configuration as in FIG. 1J. When in the open position, housing 15*j* provides an opening that allows articles such as paper clips 18*j* to be placed in or removed from the enclosure.

Figures 1K, 1L:
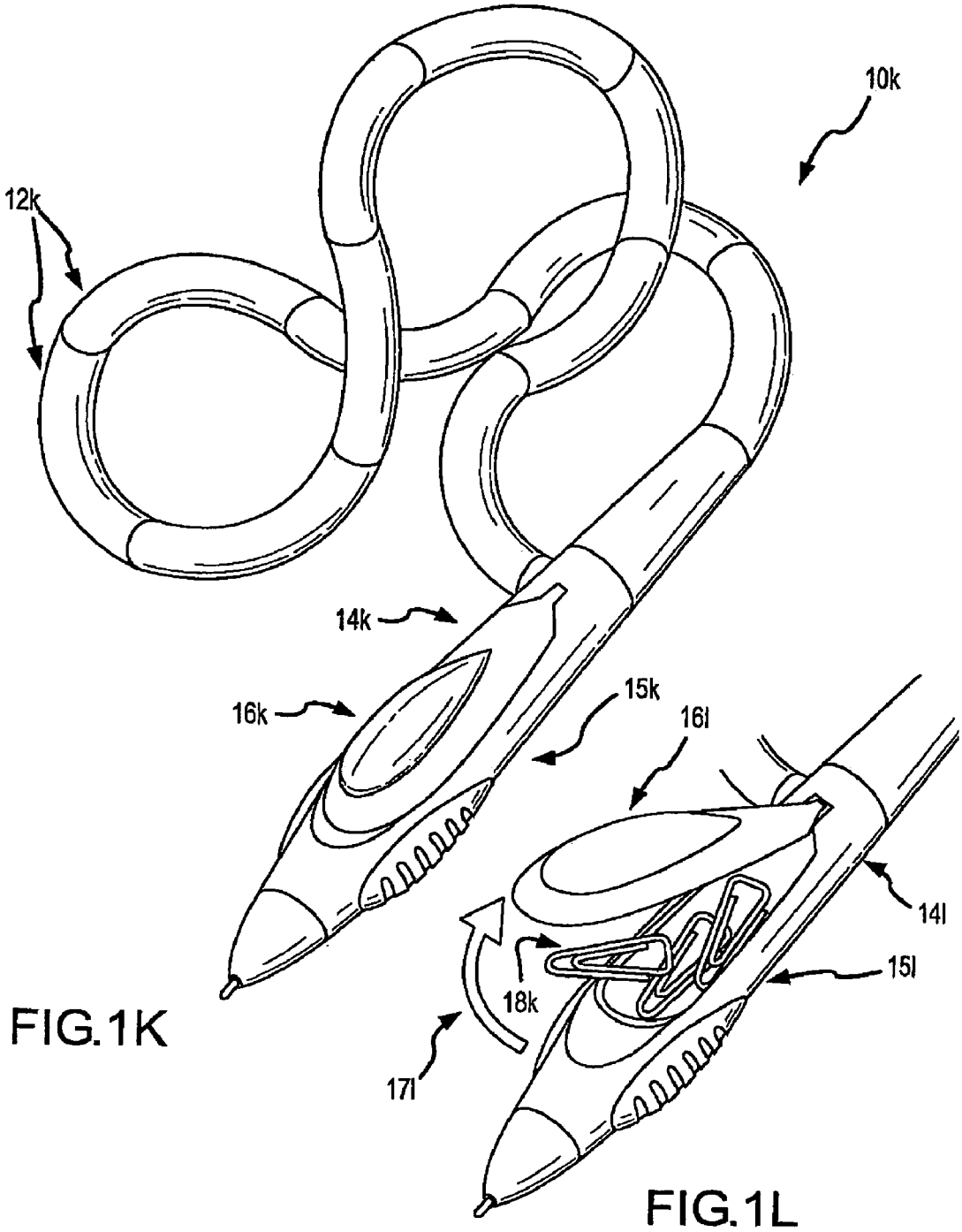
FIGS. 1K and 1L illustrate a seventh embodiment of a writing instrument in accordance with the present invention.

FIG. 1K illustrates a writing instrument 10*k* according to one embodiment of the present invention. Writing instrument 10*k* includes a plurality of rotatably coupled links 12*k* that can be interchangeable with one another. Links 12*k* can be connected together and with a writing instrument body 14*k* as described above. Instrument body 14*k* also includes a housing 15*k* defining an enclosure which is adapted to receive at least one article. As shown in FIG. 1L, instrument body 14*l* may also include a housing cover 16*l*, such that housing cover 16*l* and housing 15*l* and/or instrument body 14*l* are in hinged cooperation each other, as indicated by arrow 17*l*. In this way, the writing instrument can adopt a closed configuration as in FIG. 1K or an open configuration as in FIG. 1L. When in the open position, housing 15*l* provides an opening that allows articles such as paper clips 18*l* to be placed in or removed from the enclosure.

Figure 1M:
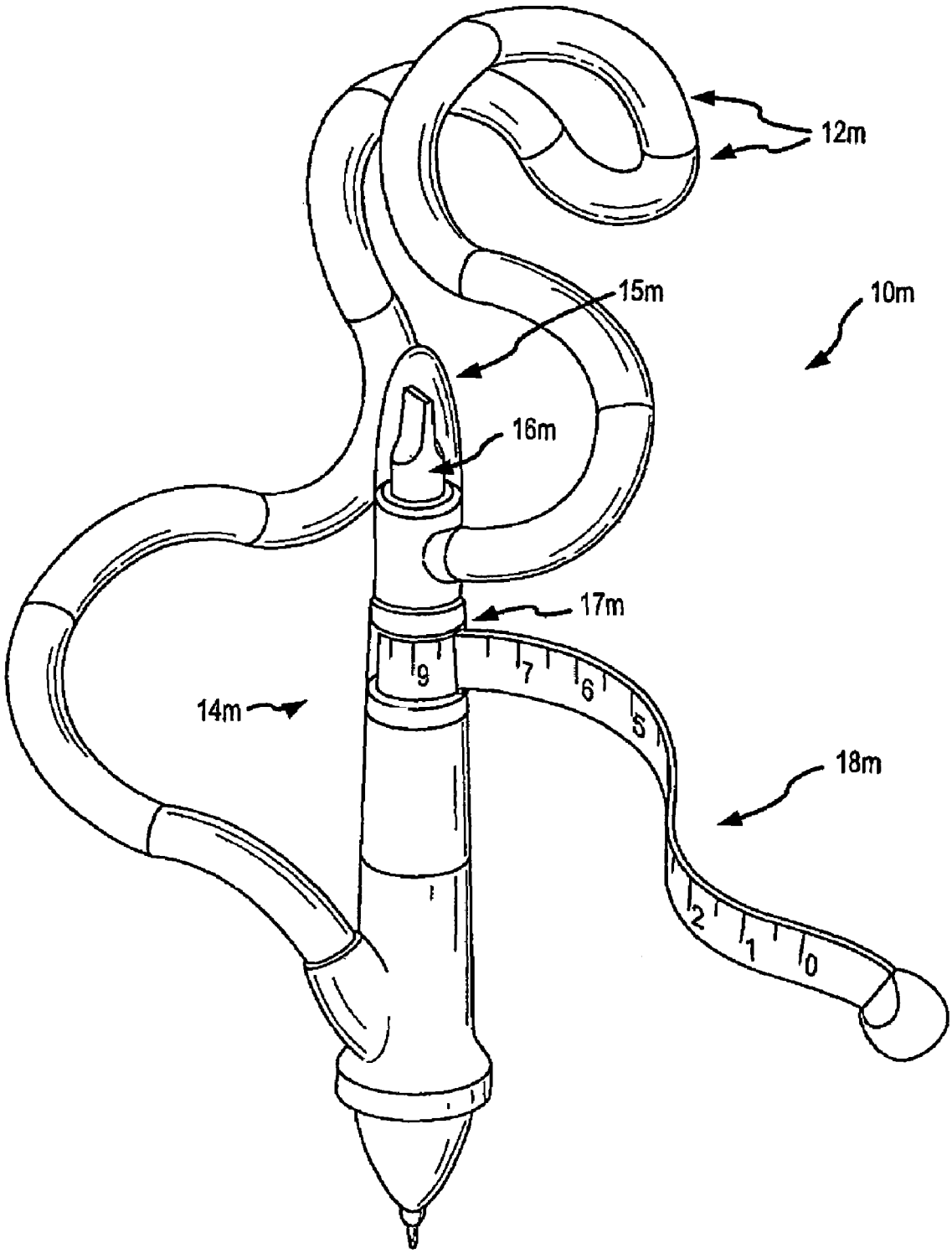
FIG. 1M illustrates an eighth embodiment of a writing instrument in accordance with the present invention.

FIG. 1M illustrates a writing instrument 10*m* according to one embodiment of the present invention. Writing instrument 10*m* includes a plurality of rotatably coupled links 12*m* that can be interchangeable with one another. Links 12*m* can be connected together and with a writing instrument body 14*m* as described above. Instrument body 14*m* also includes a cover 15*m* defining an enclosure which is adapted to house at least one article, such as a screw driver head 16*m*. Instrument body 14*m* may also include an attachment 17*m* for coupling with one or more accessories, such as a tape measure 18*m*.

Figure 1N:
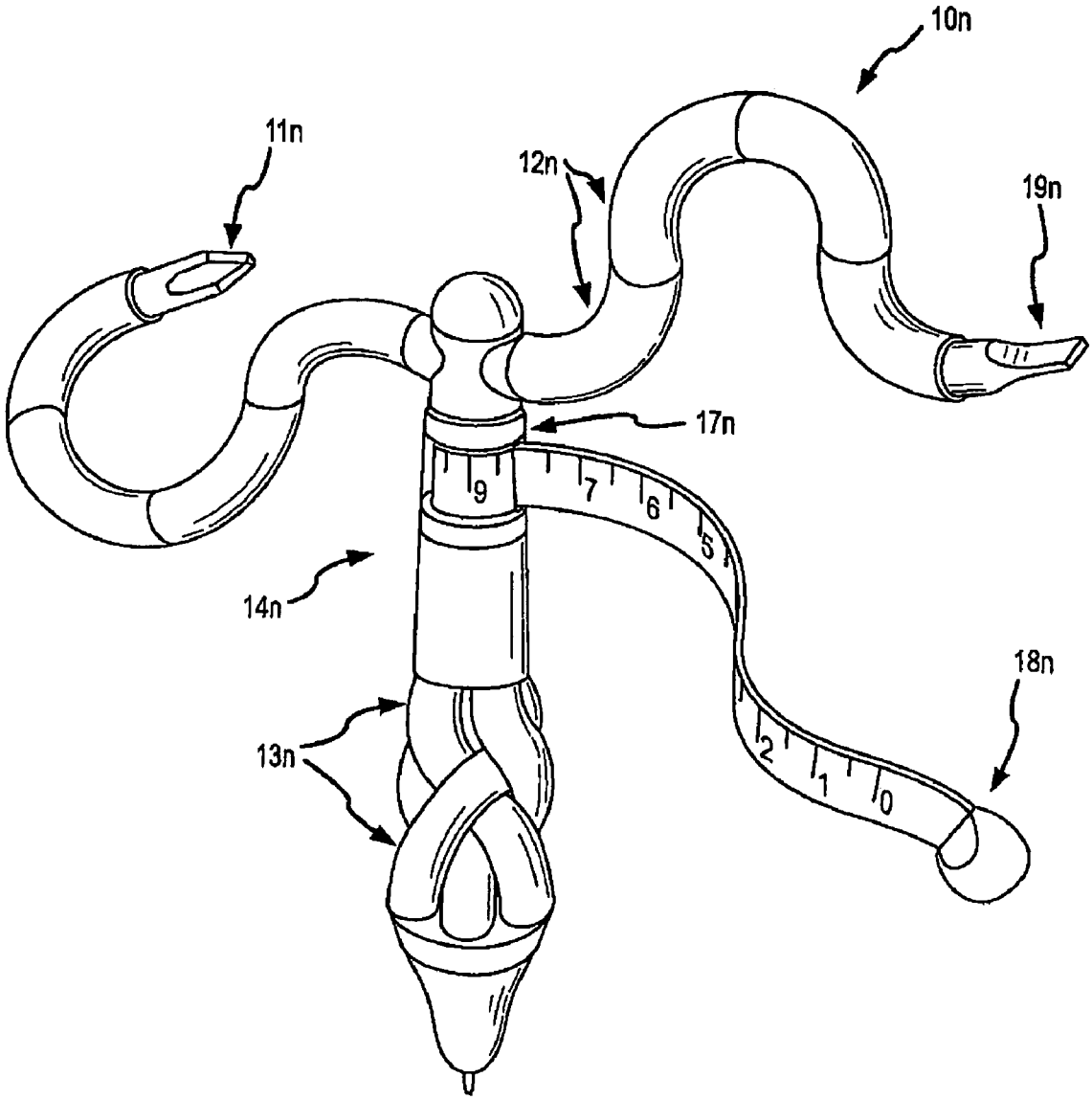
FIG. 1N illustrates a ninth embodiment of a writing instrument in accordance with the present invention.

FIG. 1N illustrates a writing instrument 10*n* according to one embodiment of the present invention. Writing instrument 10*n* includes a plurality of rotatably coupled links 12*n* that can be interchangeable with one another. Links 12*n* can be connected together and with a writing instrument body 14*n* as described above. One or more links 12*n* can be coupled with a tool, such as a Phillips head screwdriver 11*n* or a standard head screwdriver 19*n*. Instrument body 14*n* may also include an attachment 17*n* for coupling with one or more accessories, such as a tape measure 18*n*. Writing instrument body 14*n* can incorporate one or more integral links 13*n*.

FIG. 1O illustrates a writing instrument 10*o* according to one embodiment of the present invention. Writing instrument 10*o* includes a plurality of rotatably coupled links 12*o* that can be interchangeable with one another. Links 12*o* can be connected together and with a writing instrument body 14*o* as described above. Writing instrument 10*o* can include a number of sets of serially pivotally coupled segments. Here, two sets are shown.

Figure 1P:
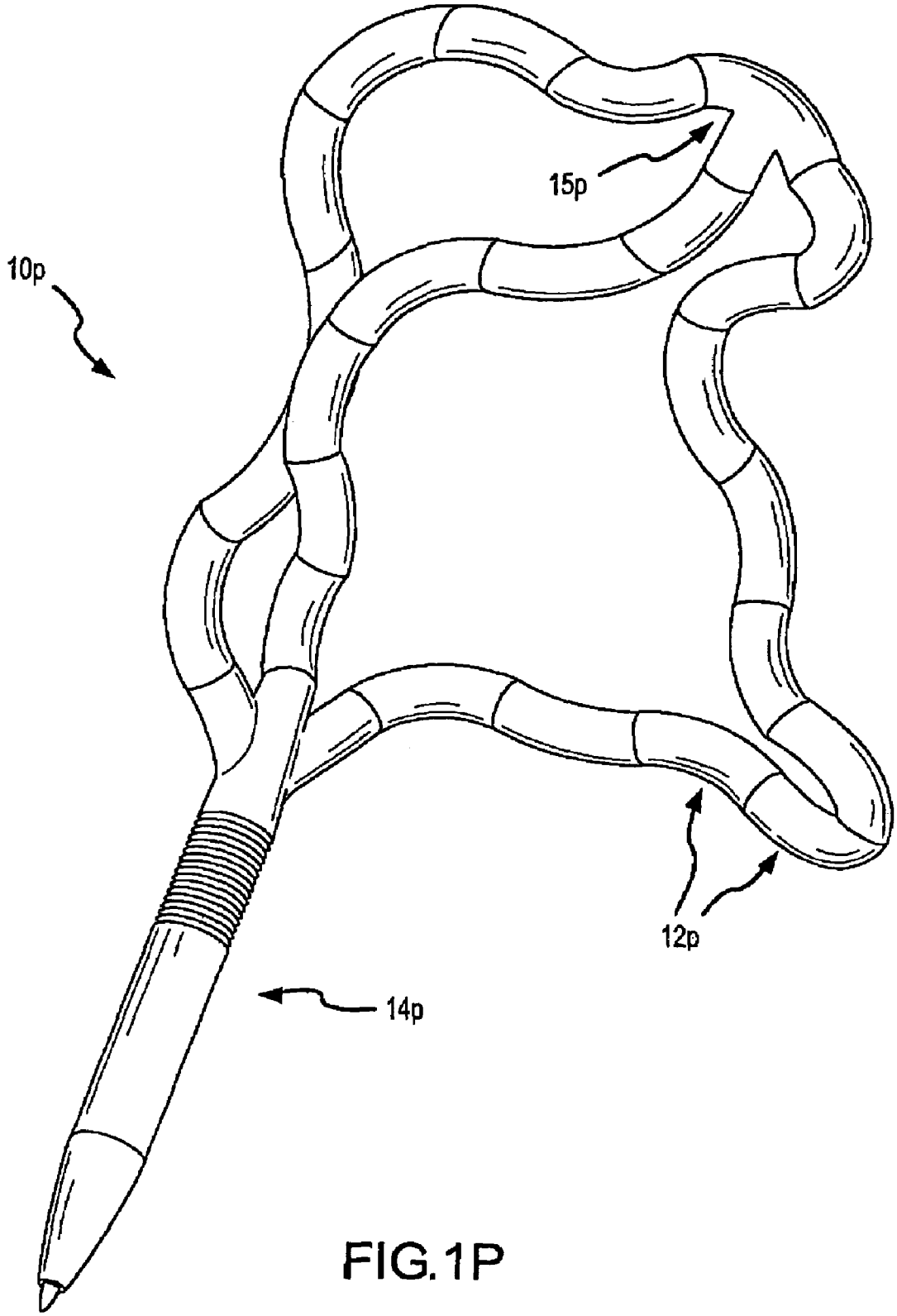
FIG. 1P illustrates an eleventh embodiment of a writing instrument in accordance with the present invention.

FIG. 1P illustrates a writing instrument 10*p* according to one embodiment of the present invention. Writing instrument 10*p* includes a plurality of rotatably coupled links 12*p* that can be interchangeable with one another. Links 12*p* can be connected together and with a writing instrument body 14*p* as described above. Writing instrument 10*p* may also include a coordinating segment or link 15*p* that can pivotally couple with three or more other segments.

Figure 1Q:
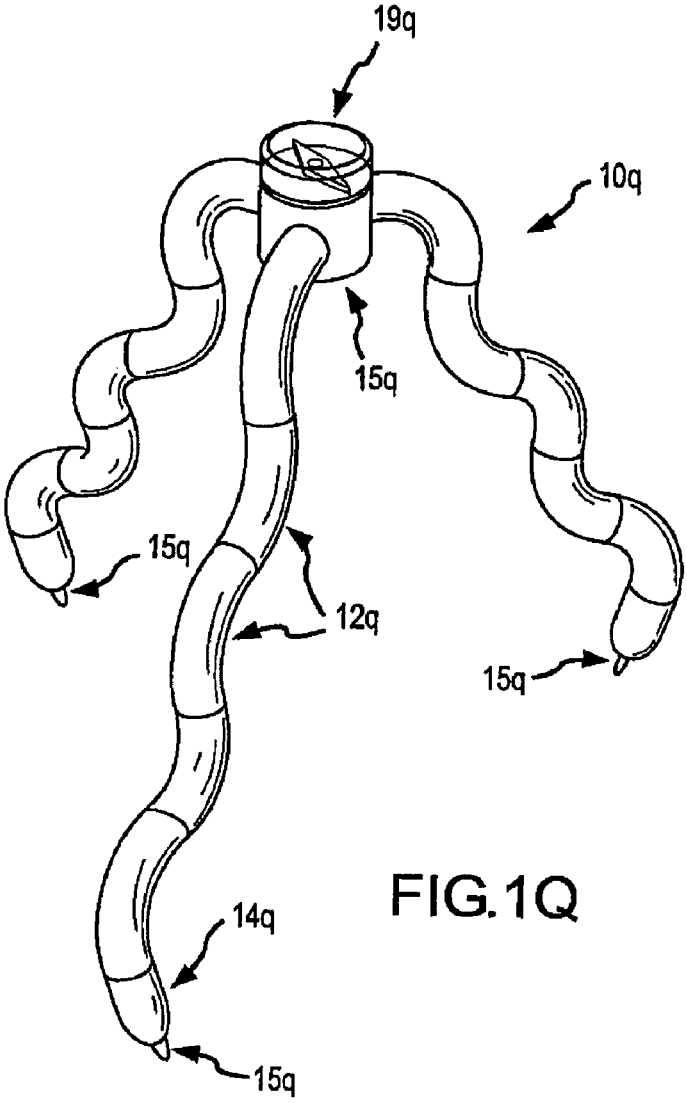
FIG. 1Q illustrates a twelfth embodiment of a writing instrument in accordance with the present invention.
Figure 1R:
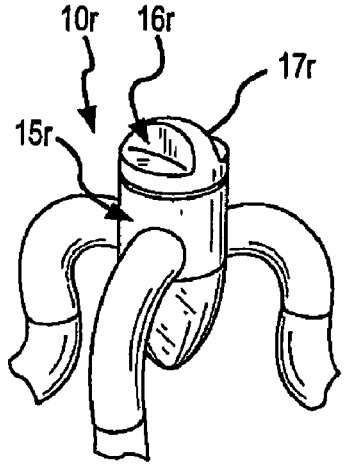
FIG. 1R illustrates a thirteenth embodiment of a writing instrument in accordance with the present invention.
Figure 1S:
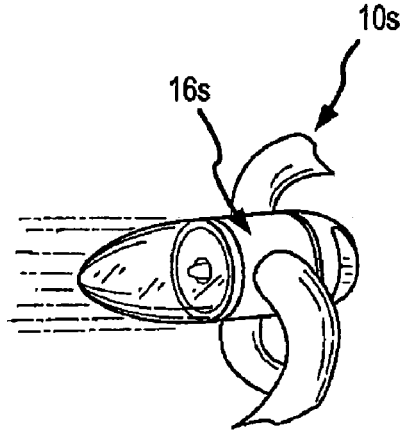
FIG. 1S illustrates a fourteenth embodiment of a writing instrument in accordance with the present invention.
Figure 1T:
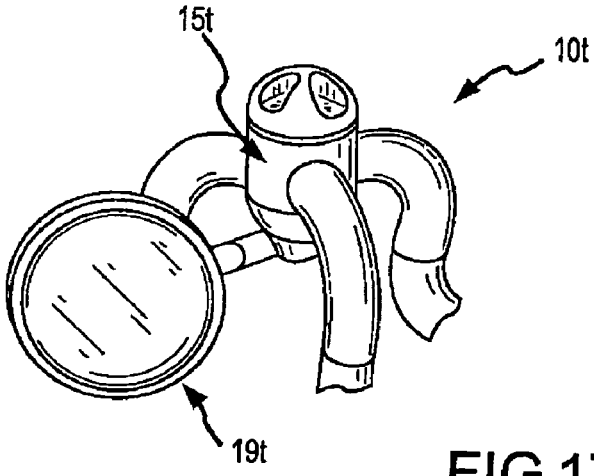
FIG. 1T illustrates a fifteenth embodiment of a writing instrument in accordance with the present invention.

FIG. 1Q illustrates a writing instrument 10*q* according to one embodiment of the present invention. Writing instrument 10*q* includes a plurality of rotatably coupled links 12*q* that can be interchangeable with one another. Links 12*q* can be connected together and with a writing instrument body 14*q* as described above. Writing instrument 10*q* may also include a coordinating segment or link 15*q* that can pivotally couple with three or more other segments. Link 15*q* can include one or more accessories, such as a compass 19*q*. Writing instrument 10*q* can also include one or more writing elements 15*q*, which may include any of a variety of combinations of writing mediums, such as inks, dyes, leads, and the like. These writing mediums can include various colors, thicknesses, hues, tints, and the like. FIG. 1R shows a coordinating segment or link 15*r* of a writing instrument 10*r*, wherein link 15*r* includes a light 16*r* and a light switch 17*r*. FIG. 1S shows a writing instrument 10*s* with an illuminated light 16*s*. FIG. 1T shows a writing instrument 10*t* having a coordinating segment or link 15*t* with an attached accessory, such as a magnifying glass 19*t*.

Figure 1U:
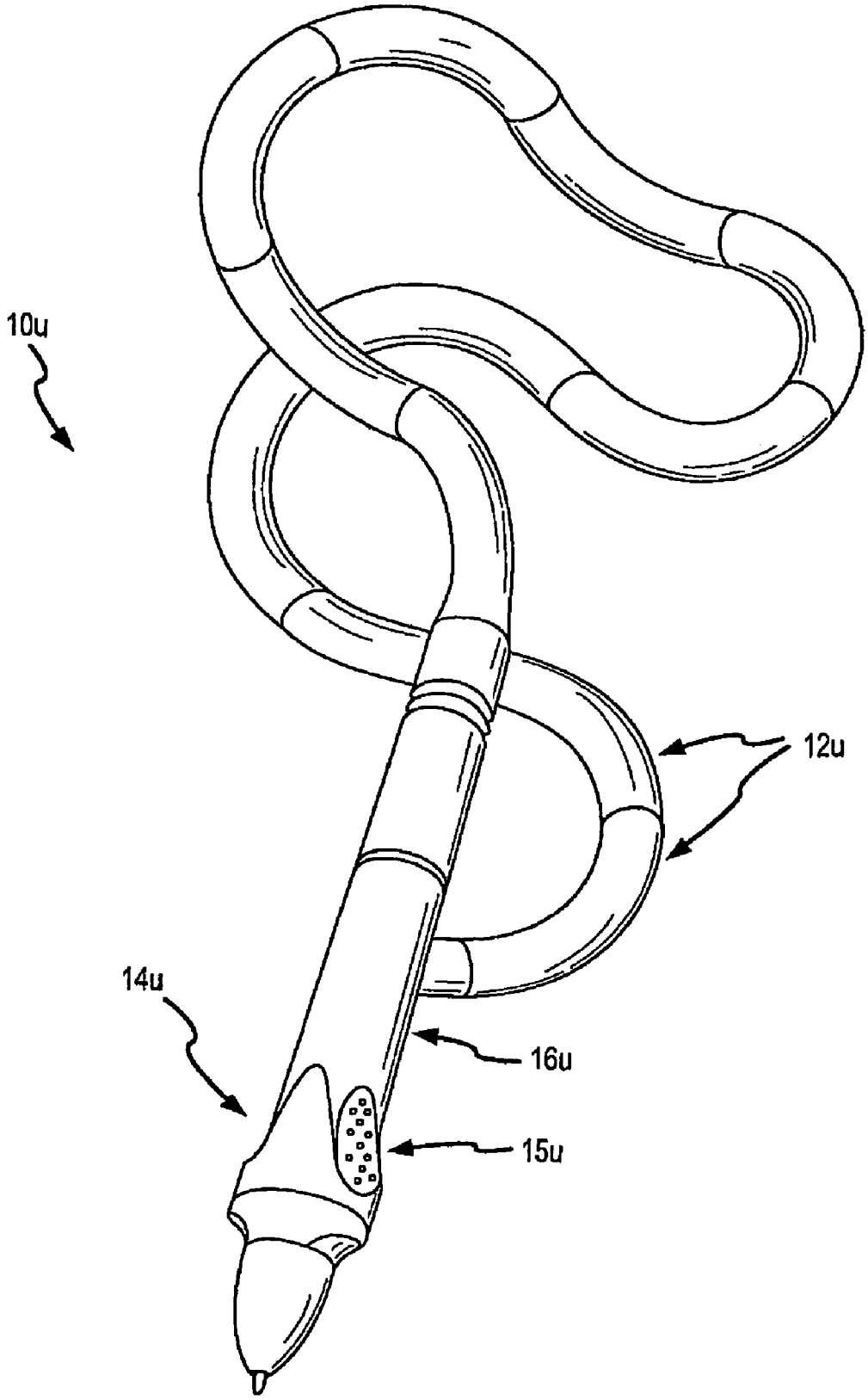
FIG. 1U illustrates a sixteenth embodiment of a writing instrument in accordance with the present invention.

FIG. 1U illustrates a writing instrument 10*u* according to one embodiment of the present invention. Writing instrument 10*u* includes a plurality of rotatably coupled links 12*u* that can be interchangeable with one another. Links 12*u* can be connected together and with a writing instrument body 14*u* as described above. Writing instrument 10*u* can include a finger grip 15*u* with raised nodules and a rounded body surface 16*u*.

Figure 1V:
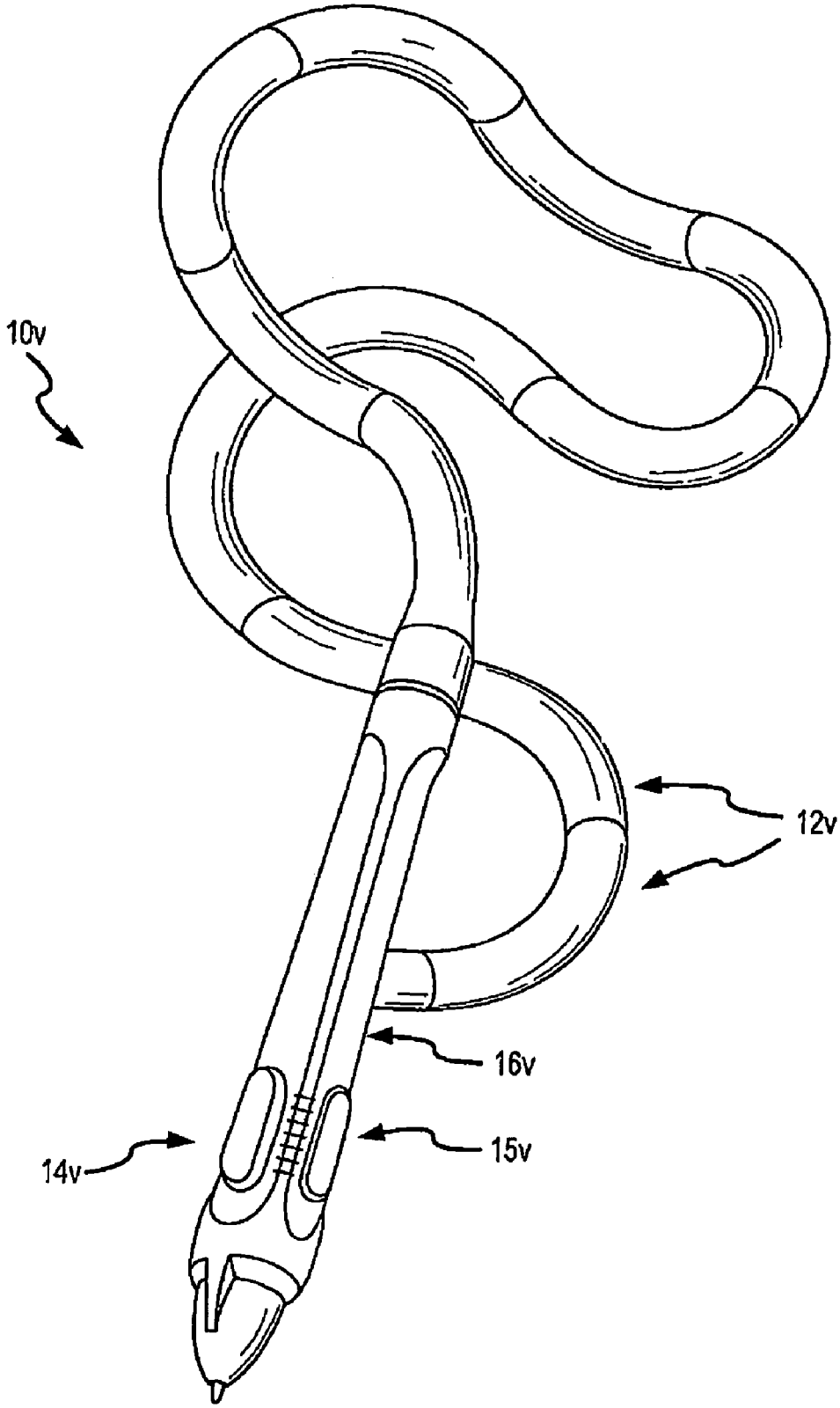
FIG. 1V illustrates a seventeenth embodiment of a writing instrument in accordance with the present invention.

FIG. 1V illustrates a writing instrument 10*v* according to one embodiment of the present invention. Writing instrument 10*v* includes a plurality of rotatably coupled links 12*v* that can be interchangeable with one another. Links 12*v* can be connected together and with a writing instrument body 14*v* as described above. Writing instrument 10*v* can include a flattened finger grip 15*v* and a scooped body surface 16*v*.

Figure 1W:
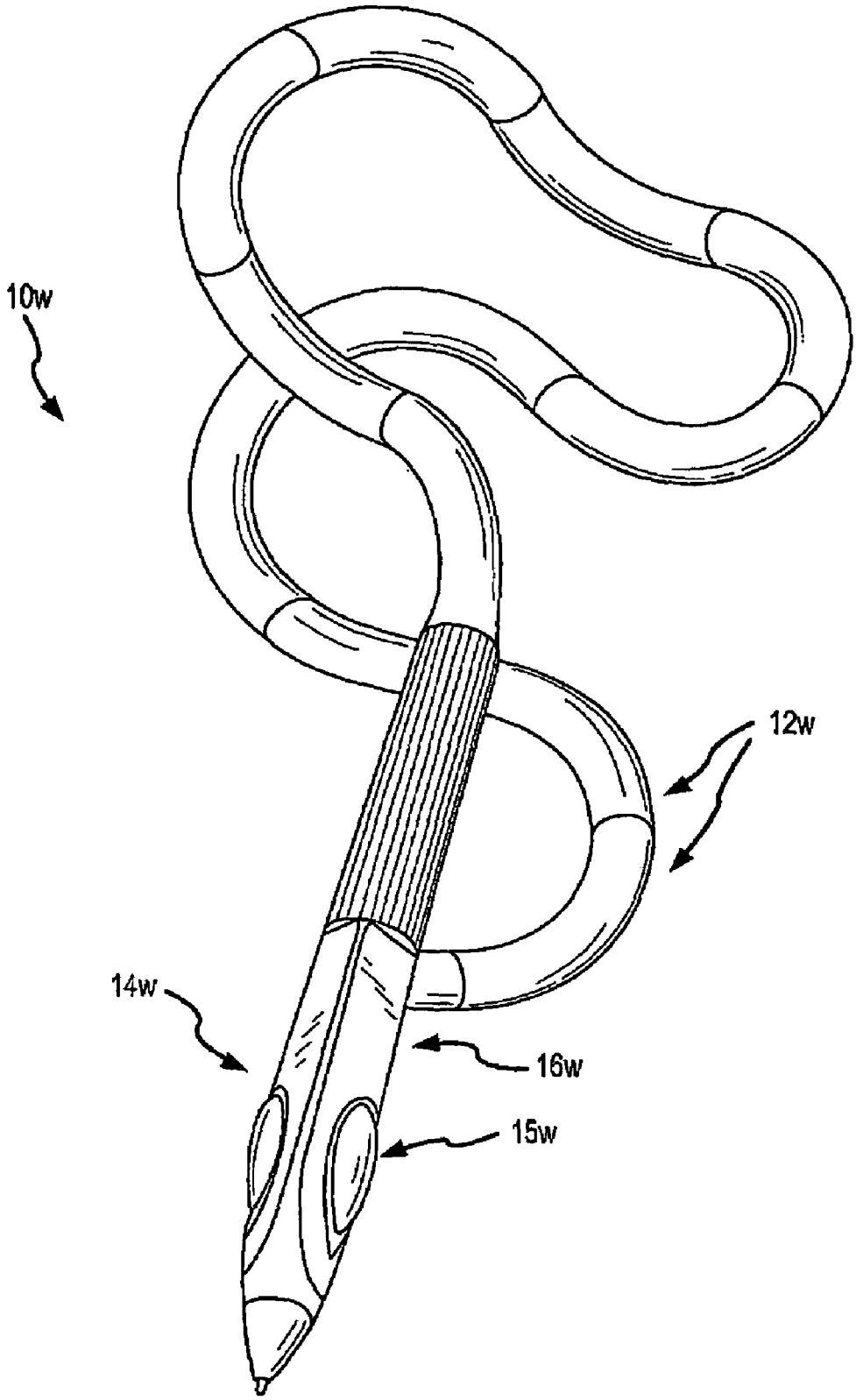
FIG. 1W illustrates an eighteenth embodiment of a writing instrument in accordance with the present invention.

FIG. 1W illustrates a writing instrument 10*w* according to one embodiment of the present invention. Writing instrument 10*w* includes a plurality of rotatably coupled links 12*w* that can be interchangeable with one another. Links 12*w* can be connected together and with a writing instrument body 14*w* as described above. Writing instrument 10*w* can include a rounded finger grip 15*w* and a body surface 16*w* having a flat portion and a textured ridged portion.

Figure 1X:
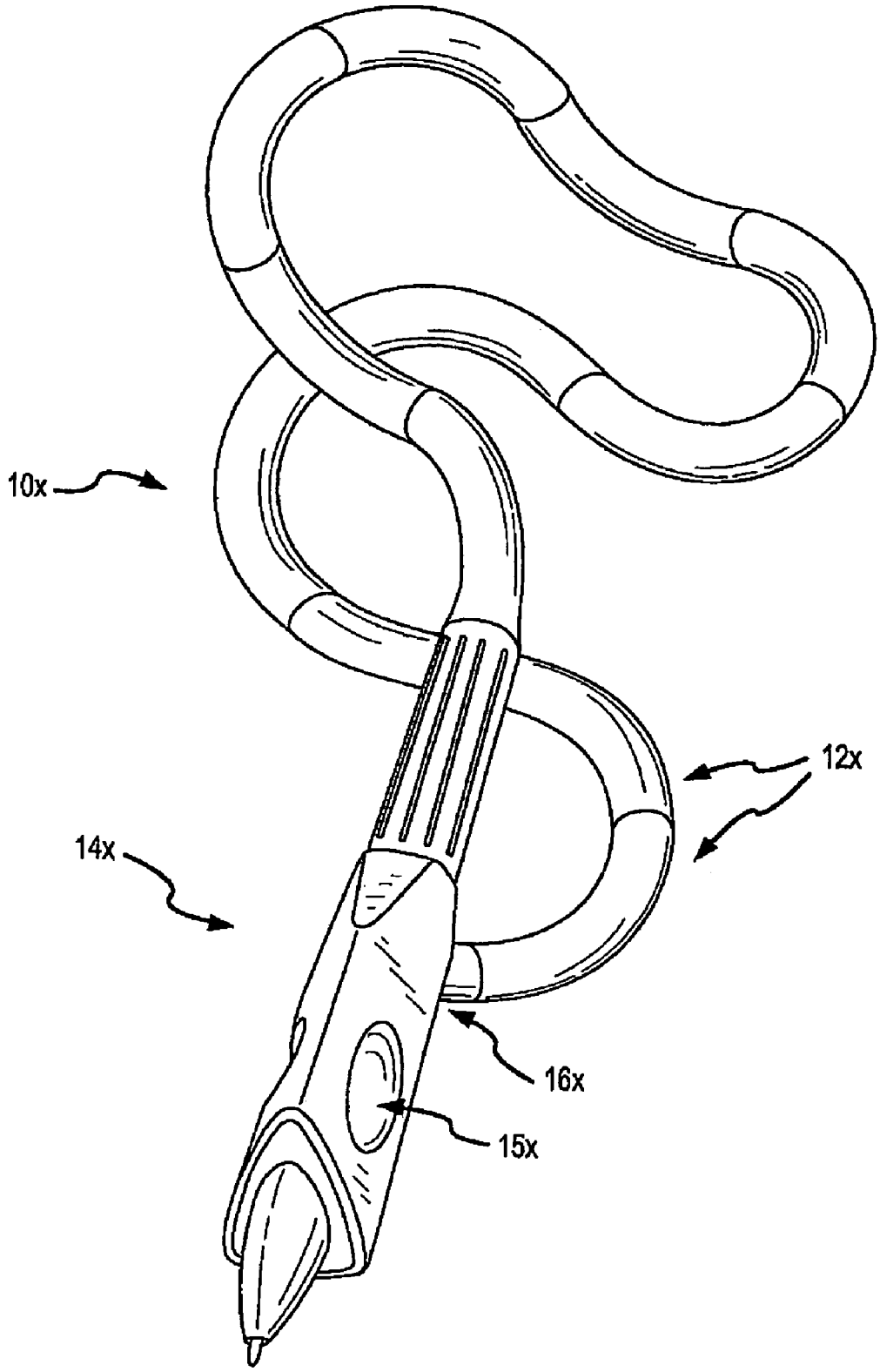
FIG. 1X illustrates a nineteenth embodiment of a writing instrument in accordance with the present invention.

FIG. 1X illustrates a writing instrument 10*x* according to one embodiment of the present invention. Writing instrument 10*x* includes a plurality of rotatably coupled links 12*x* that can be interchangeable with one another. Links 12*x* can be connected together and with a writing instrument body 14*x* as described above. Writing instrument 10*x* can include a scooped finger grip 15*x* and a body surface 16*x* having a flat portion and a textured ridged portion.

As seen in, for example, FIGS. 1U-X, a writing instrument according to the present invention can have a writing instrument body that includes any of a variety of grip configurations and surfaces, whereby the user can grasp the writing instrument body with their fingertips. Similarly, various configurations and surfaces are provided for the body surface. The grip (e.g. 15*u*, 15*v*, 15*w*, and 15*x*) and body surface (e.g. 16*u*, 16*v*, 16*w*, and 16*x*) can include any of a variety of materials. For example, the grip may include a silicon gel. In some embodiments, the body surface includes an aeronautical aluminum alloy, a heat tempered steel, or a carbon fiber material. In related embodiments, the grip is filled with fluid Plasmium™ that can be displaced when pressure is applied with one's fingertips. What is more, it is appreciated that any of the materials and textures described herein with respect to the segment or link coatings can also be used for the manufacture of the grip or body surface coatings.

Figure 1Y:
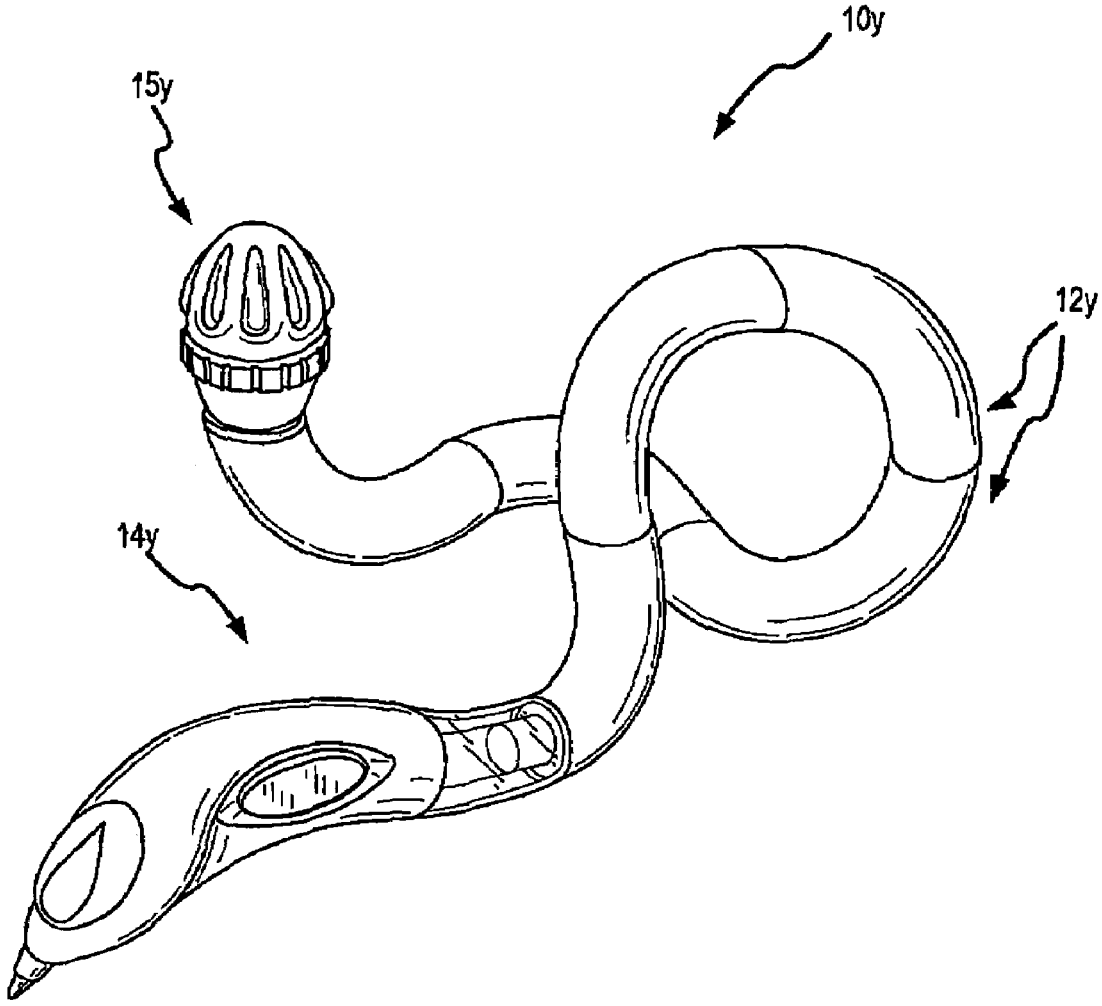
FIG. 1Y illustrates a twentieth embodiment of a writing instrument in accordance with the present invention.

FIG. 1Y illustrates a writing instrument 10*y* according to one embodiment of the present invention. Writing instrument 10*y* includes a plurality of rotatably coupled links 12*y* that can be interchangeable with one another. Links 12*y* can be connected together and with a writing instrument body 14*y* as described above. A link 12*y* can include any of a variety of accessories, such as a light 15*y*. In some embodiments, light 15*y* can be activated and/or deactivated by twisting the light, or by pressing an associated switch as shown in FIG. 1R. In related embodiments, a battery or other power source for light 15*y* may be housed in or coupled with a link 12*y*.

Figure 2A:
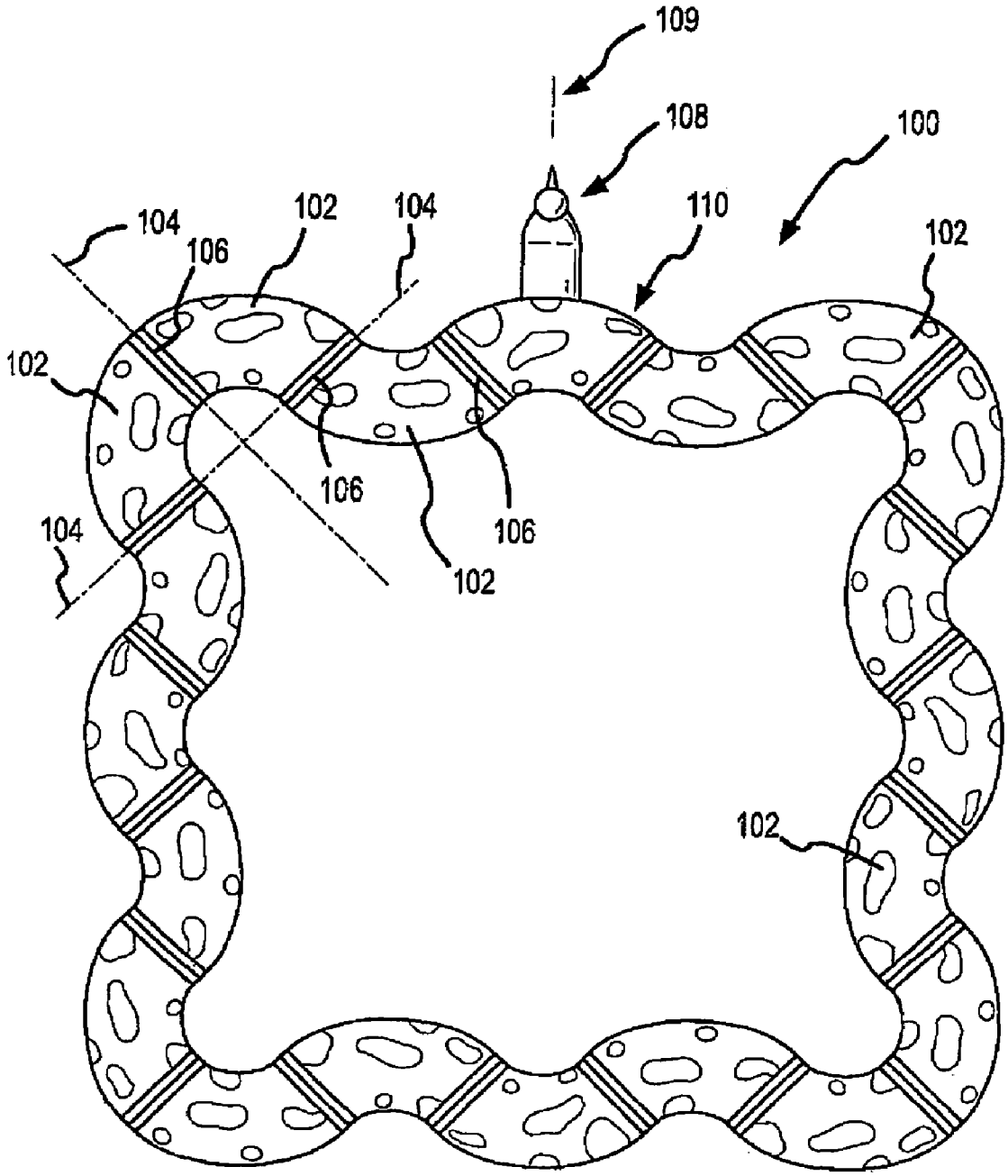
FIG. 2A illustrates an eleventh embodiment of a writing instrument in accordance with the present invention.

FIG. 2A illustrates a writing instrument 100 in accordance with one embodiment of the present invention. Writing instrument 100 includes a plurality of rotatably coupled links 102 that are interchangeable with one another. The links are connected end-to-end to form a ring. As shown here, link 110 includes a writing element 108. In some embodiments, writing element 108 extends from a side of link 110 so as not to interfere with an end interface 106 that connects link 110 with the adjacent links or segments. In related embodiments, writing element 108 protrudes from link 110 in a radial direction 109 outwardly from a longitudinal axis defined by the link.

Figure 2B:
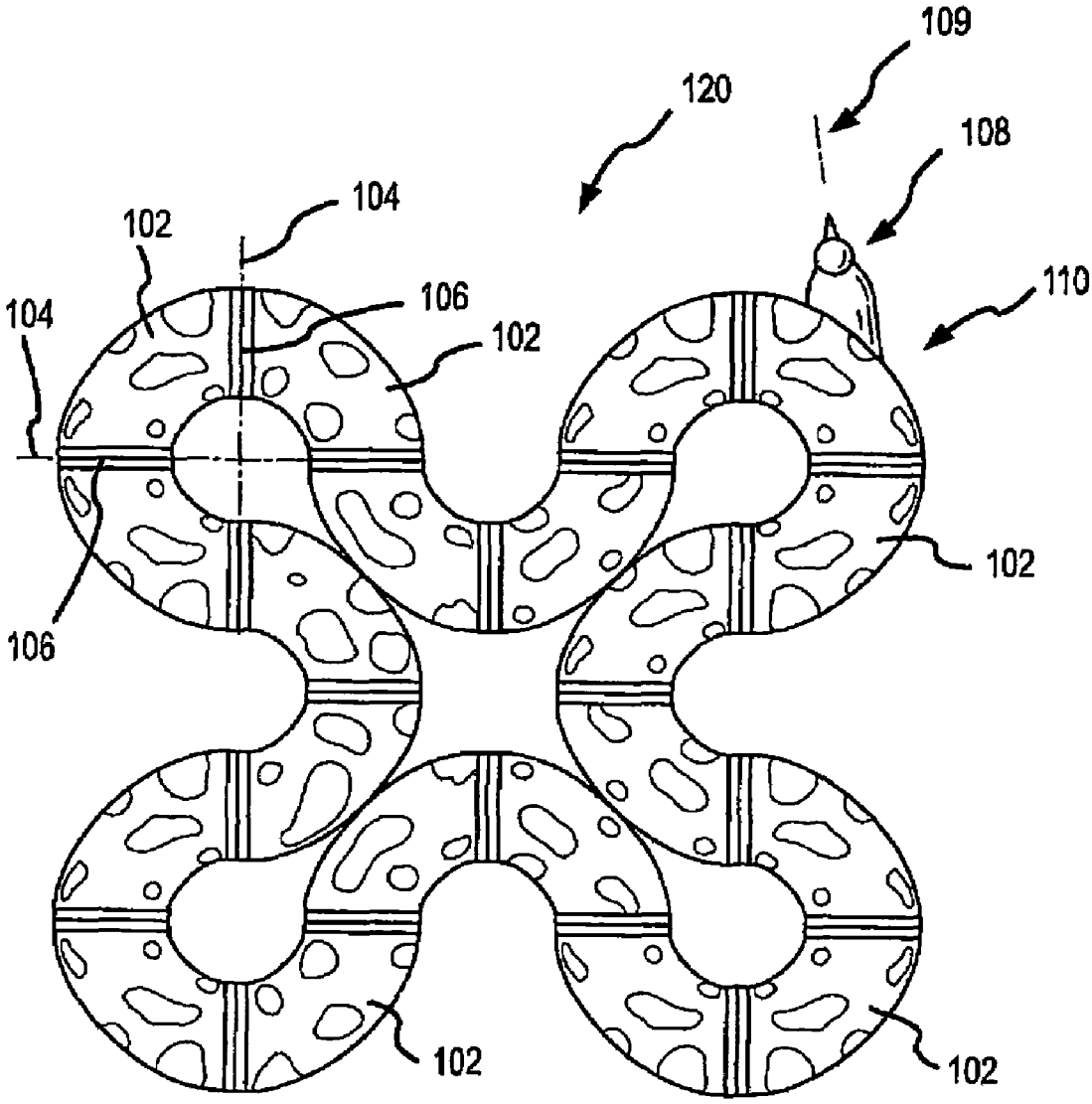
FIG. 2B illustrates a twelfth embodiment of a writing instrument in accordance with the present invention.
Figure 3:
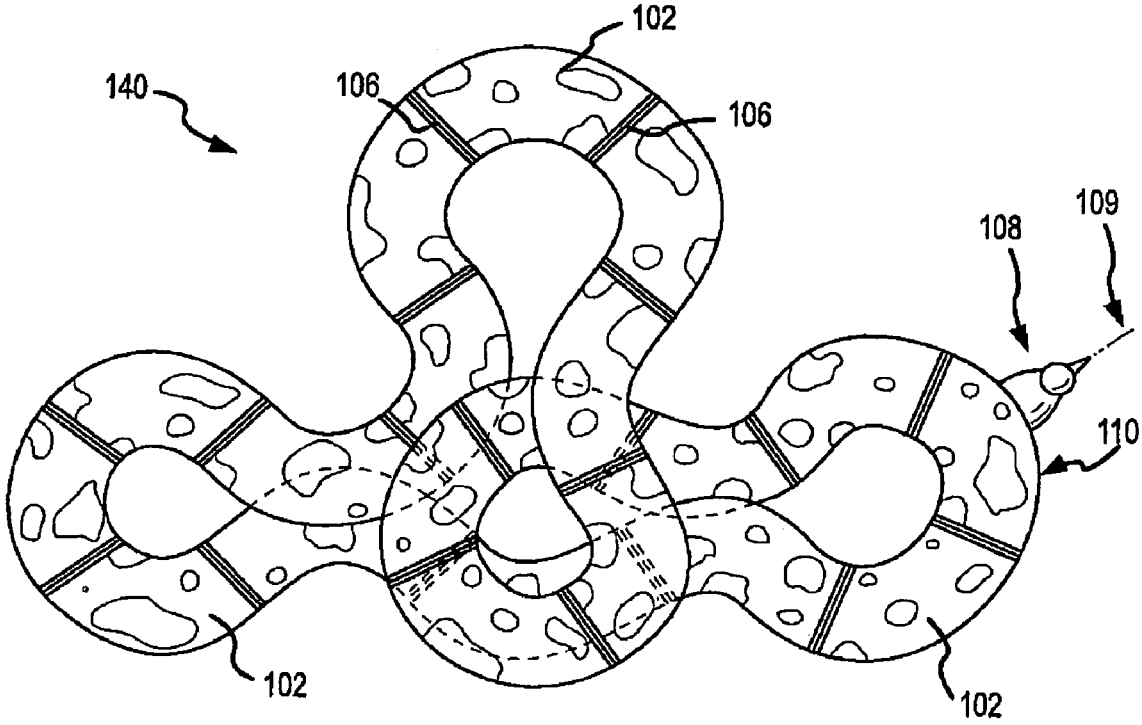
FIG. 3 illustrates a thirteenth embodiment of a writing instrument in accordance with the present invention.

Writing instrument 100 may be twisted into an infinite variety of configurations, such as the unique and decorative clover leaf 120 shown in FIG. 2B (particularly when the instrument has twenty segments) and the random design 140 shown in FIG. 3. The designs in the embodiments of FIGS. 2A and 3 have twenty segments, which can be seen in the flat configuration shown in FIG. 2A. Every segment 102 can have a twisting axis 104 at each end thereof which passes through an end interface 106 between each pair of adjacent segments. Each segment may be twisted relative to either adjacent segment through 360 degrees by displacing or flipping the remainder of writing instrument 100.

Writing instrument 100 has an amazing retention property, which causes the segments thereof to remain in the last configuration set by the user. Writing instrument 100 is readily twistable into new configurations (e.g. instrument 120, 140 of FIGS. 2B and 3), but tends to retain the prior configuration until retwisted. In some embodiments, each extension fits snugly into the cooperating channel of the adjacent segment, which aids the retention property. In addition, some configurations have points of contact between segments that touch (and with the support surface). These contact points permit mutual leaning and support, which aids in configuration retention.

Another source of retention is due to the subtle relationship between the interface twisting axes 104. Twisting axes 104 are randomly oriented. The probability of two axes being perfectly aligned or coincident in a given configuration is highly remote. Such alignments, when they do occur, offer less resistance to pivoting because they involve the snug-static friction of only the aligned interfaces. In the usual non-aligned case, more interfaces are involved, and entire sections of the writing instrument must be simultaneously twisted and shifted as a unit in order to move a single segment.

Writing instrument 100 of FIG. 2A is formed by twenty identical torus segments 102 connected end-to-end to form a continuous annular device. Each segment 102 is a 90-degree section of a torus, having a curved body portion, with recessed face at one end and recessed face at the other end.

The torus curve along each segment body portion 102 causes the two twisting axes of each segment to be non-aligned. A single segment 102 cannot be twisted relative to both adjacent segments at the same time without displacing other segments within the writing instrument 100. The segments 102 cannot be displaced independently.

Typically, when the user initially twists writing instrument 100, the twisting axes 104 are random and non-aligned. The initial locked group includes the entire chain of segments. The force required to displace a single segment 102 must be sufficient to disturb the entire writing instrument, simultaneously moving every segment and reorienting every twisting axis. The chain-wide disturbance proceeds until two axes come into alignment. The initial resistance to change in the writing instrument is the origin of the configuration retention characteristic. This initial resistance is at least, in part, responsible for the self-supporting feature of writing instrument 100 shown in FIG. 2A. Minor displacement forces (such as gravity and occasional bumps) acting on the writing instrument are insufficient to overcome the non-alignment resistance.

Figure 4:
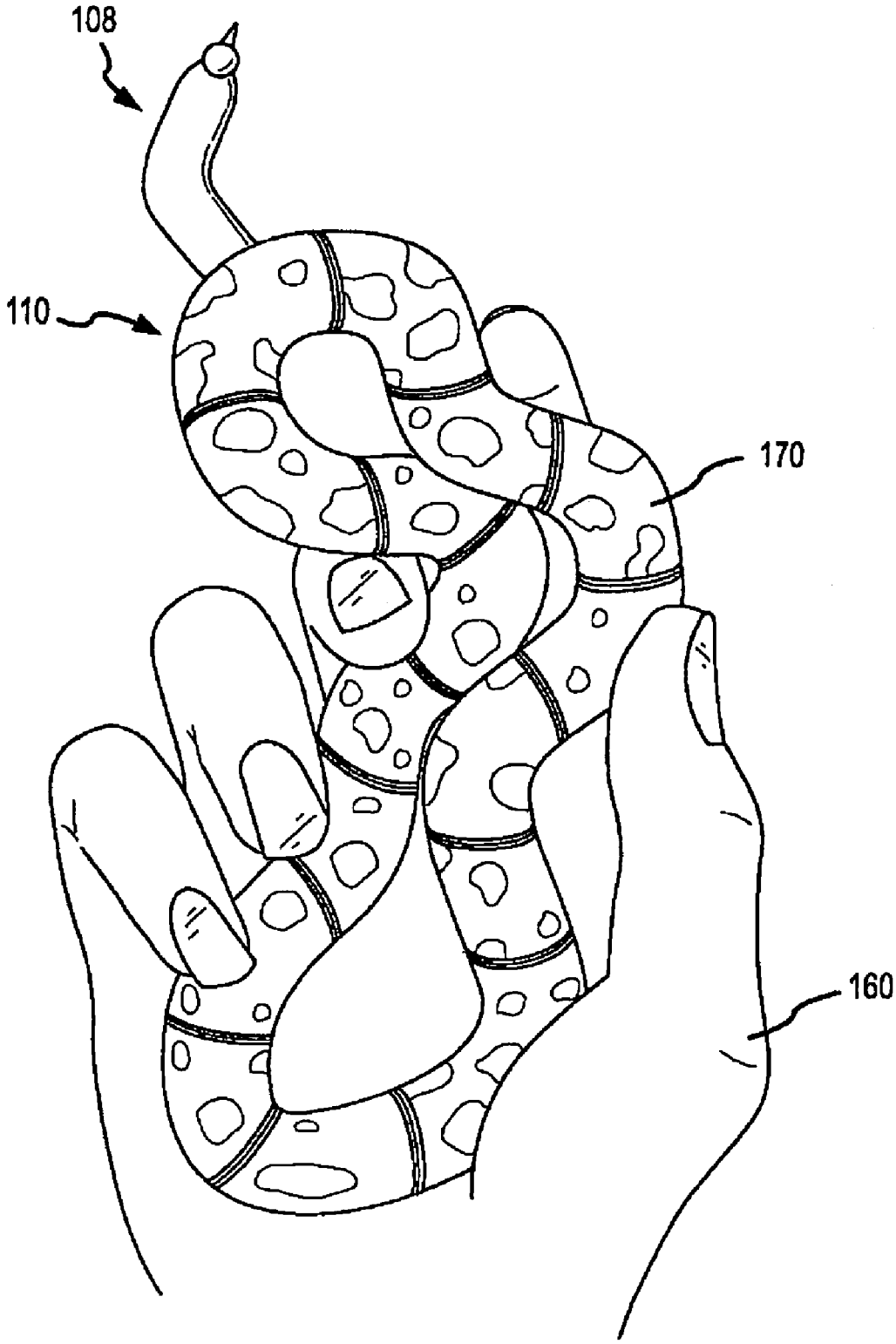
FIG. 4 illustrates use of an embodiment of a writing instrument in accordance with the present invention.

FIG. 4 illustrates an embodiment of a writing instrument 170 in operation. A user manipulates writing instrument 170 in his/her hand 160 by twisting and turning the segments to form a unique shape or design. The twisting, turning and rotating motion of hand 160 provides strengthening for the hand and finger muscles as well as rehabilitation for the joints. Writing instrument 170 can also be used as a mental distraction for a person who is trying to quit smoking. For example, when a smoker is on the telephone, he/she may instinctively light up a cigarette to keep his/her hands busy. Writing instrument 170 replaces the habitual lighting and smoking of a cigarette, and occupies a smoker's hands and brain, thus replacing the function of the cigarette.

The coatings on the links may be essentially any type of color, including translucent or transparent, and may have a variety of thicknesses, textures, durometers, compression deflection pressures, and the like. Merely by way of example, the thickness of the coating may be in the range from about 1 mm to about 6 mm, and more preferably from about 2 mm to about 4 mm. Examples of textures that may be used include dots, detents, dimples, lines, roughened, smooth, sticky, and the like.

Figure 5A:
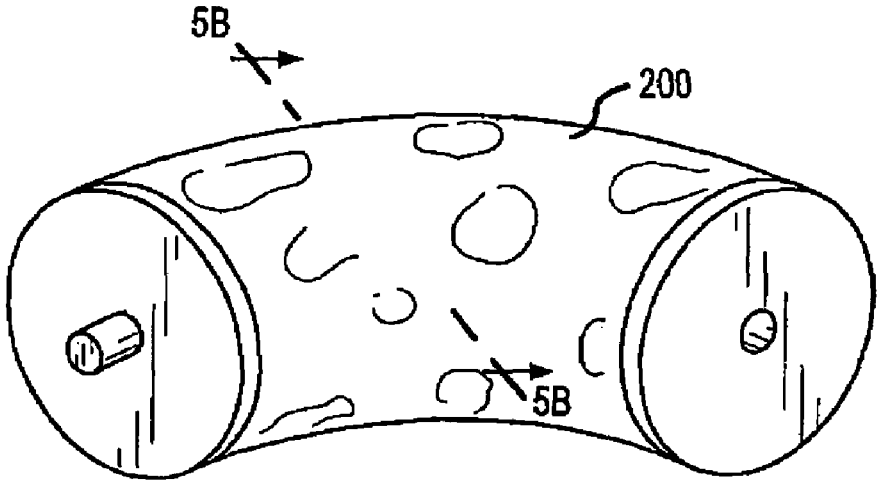
FIG. 5A illustrates a first textured coating on a single segment of a writing instrument in accordance with one embodiment of the present invention.

FIG. 5A illustrates a single textured pivotally connected segment 102 from writing instrument 100. Segment 102 has two ends 103 and 105 and a shaft 107 with a relatively small diameter. The ends and shaft may be constructed of a hard material, such as a hard plastic, polycarbonate, wood, metal or the like. A textured coating 200 is applied to the outer surface of segment 102 (and particularly about the shaft 107) thus providing a surface that is soft and malleable such that it creates a pleasant sensation and feel to the user's hands and fingers. In addition, the soft texturing of the surface of the segments reduces hand fatigue, thus allowing the user to manipulate the writing instrument for longer periods of time. Textured coating 200 may be a rubber, plastic, silicone gel, composite material or the like, however, those skilled in the art will understand that any coating may be used that is consistent with the properties of the above listed coatings.

Figure 5B:
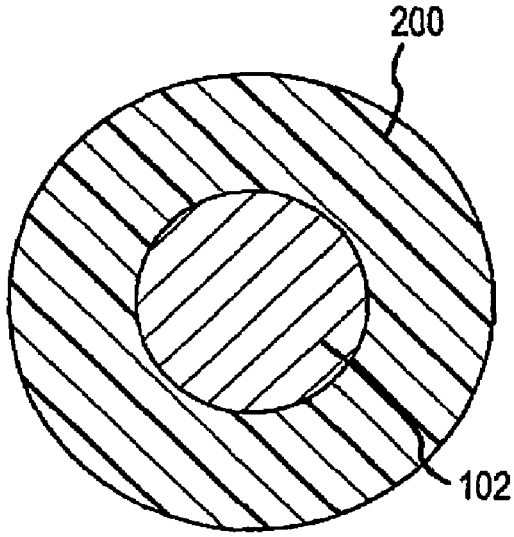
FIG. 5B is a cross-sectional view of the segment of FIG. 5A in accordance with one embodiment of the present invention.

FIG. 5B shows the cross-sectional view of the textured coating 200 applied to the surface of textured pivotally connected segment 102 shown in FIG. 5A. In one embodiment, texture coating 200 is applied to the surface of segment 102 (and particularly shaft 107) using the process of insert molding or injection molding, however, any manufacturing process may be used that adheres a textured coating to a segment surface. First, the plastic is injected to form segment 102. Then, segment 102 is then removed from the mold. Finally, segment 102 is placed back into the mold and textured coating 200 is injected and adheres to the outer surface of segment 102. Ends 103 and 105 hold the coating in place.

Figure 6A:
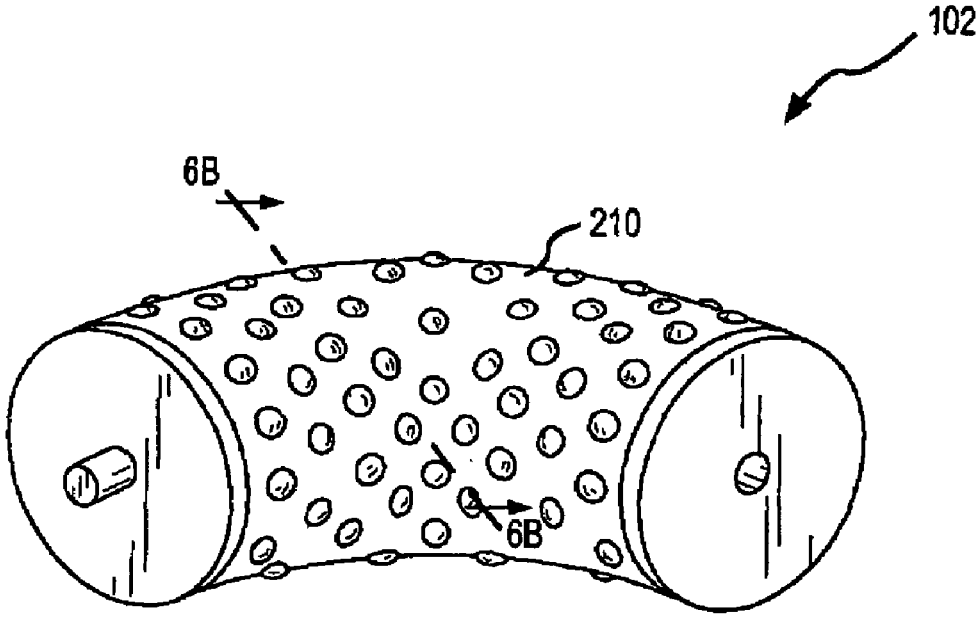
FIG. 6A illustrates a second textured coating on a single segment of a writing instrument in accordance with one embodiment of the present invention.
Figure 6B:
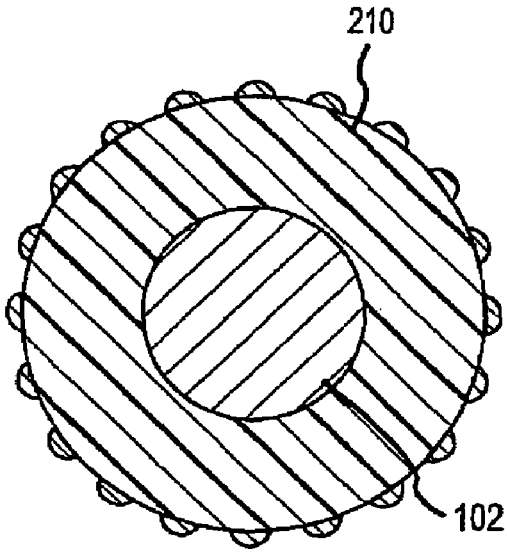
FIG. 6B is a cross-sectional view of the segment of FIG. 6A in accordance with one embodiment of the present invention.

FIG. 6A illustrates a second embodiment of textured coating 210 with raised nodules applied to a single textured pivotally connected segment 102. FIG. 6B shows a cross sectional view of the texture coating 210 with raised nodules applied to the textured pivotally connected segment 102 shown in FIG. 6A.

Figure 7:
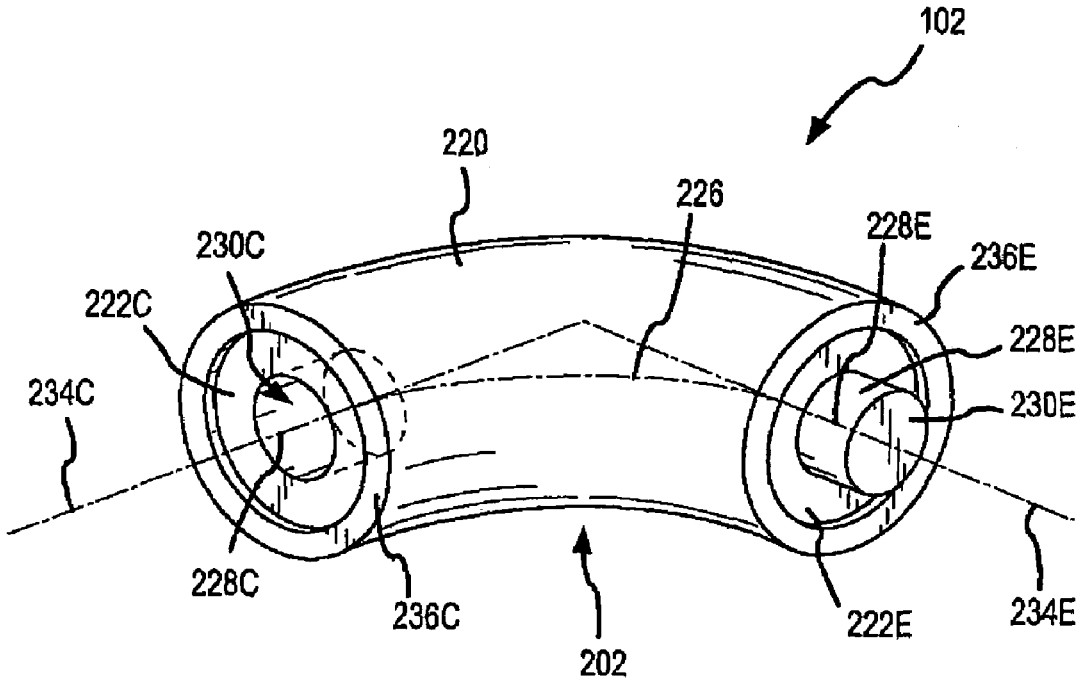
FIG. 7 illustrates a single segment of a writing instrument having connectors for adjoining adjacent segments of the writing instrument in accordance with one embodiment of the present invention.

FIG. 7 illustrates another embodiment of a single segment 202 that may have a coating added to it. In describing segment 202, it will be appreciated that segment 102 is similar in many respects. Centerline of symmetry of curved segment 202 is a 90-degree arc defining the plane of the torus segment. Centerline 226 has end points 228E and 228C. Each end face 222 defines an interface plane containing end points 228, and which is perpendicular to center line 226 at end points 228, and perpendicular to the plane of the torus segment. The interface planes are also perpendicular to each other in the 90-degree embodiment of FIG. 7.

End face 222E of each segment has a schematically shown central extension 230E, with a straight central axis 234E extending perpendicular to the interface plane. Axis 234E is tangent to curved centerline 22 at end point 228E thereof. End face 222C of each segment has a cooperating cylindrical central channel 230C with a central axis 234C extending perpendicular to the interface plane. Axis 234C is tangent to curved centerline 226 at one end point 228C thereof.

The central channel of each torus segment in the annular device has an inwardly tapering rib at its terminal portion located distally from end face 222C so as to receive the central extension-channel interface which locks a distal bulb portion of the central extension beyond the terminal portion of the central channel. Center axis 234E and 234C of each interface coincide defining a common pivoting or twisting axis. Multiple segments may be twisted into an infinite number of random configurations, each of which has a continuous closed centerline of symmetry formed by centerline 226 through each segment. End points 228 of adjacent centerlines remain coincident regardless of the complexity of the configuration of the annular device.

End faces 222 have raised peripheral rims 236E and 236C, which abut with an identical cooperating peripheral rim on the adjacent segment. Rims 236 are circular and define the common interface plane therebetween.

Figure 8:
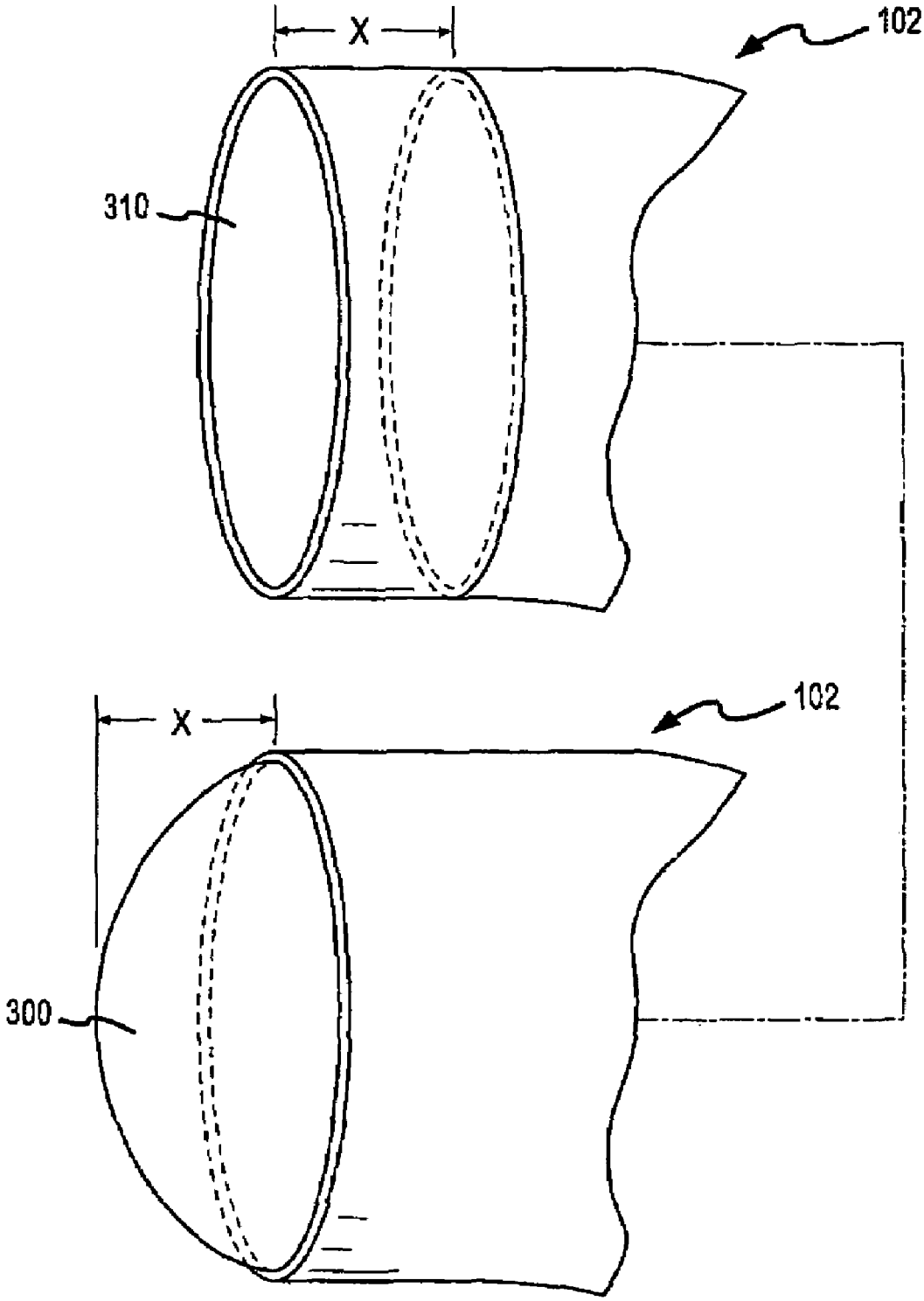
FIG. 8 illustrates one embodiment of a magnetic connector for connecting adjacent segments of a writing instrument in accordance with the present invention.

FIG. 8 illustrates a first embodiment of a magnetic connection for adjoining adjacent segments 102' of a writing instrument (having any of the coatings described herein) in accordance with one embodiment of the present invention. The magnetic connection is achieved using two opposing pole magnets 300, 310 that fit together to connect adjacent segments. The first magnet 300 is a spherical magnet on the first end face of segment 102. The second magnet is a cylindrical central channel magnet extending into the second end face of segment 102 for engaging spherical magnet 300 on the other one of the two adjacent segments for securing the plurality of segments together. Spherical magnet 300 and cylindrical channel magnet 310 are of a length X such that spherical magnet 300 fits securely into cylindrical channel magnet 310 and creates the connection between adjacent segments of writing instrument 100.

Figure 9A:
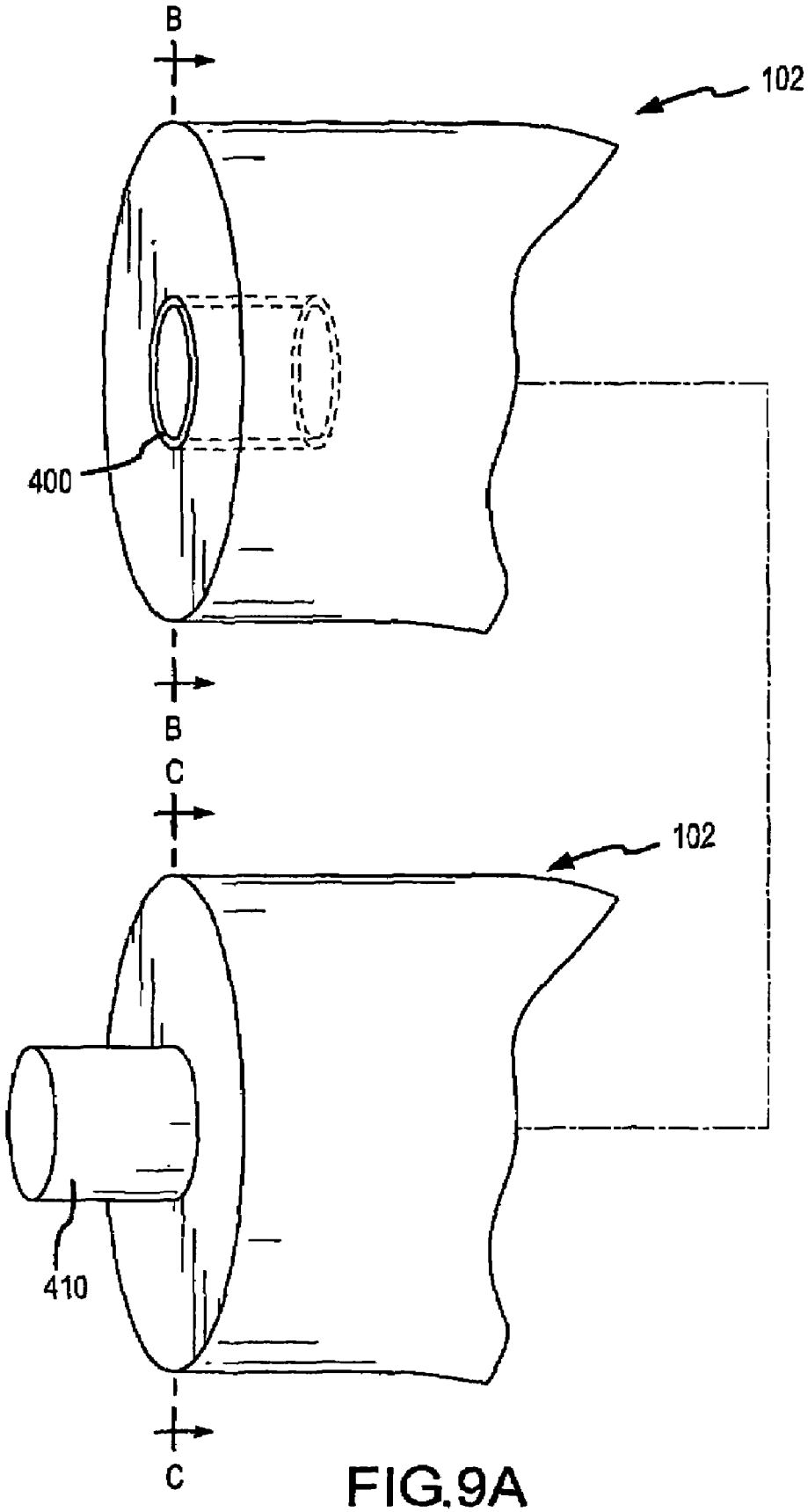
FIG. 9A illustrates a second embodiment of a magnetic connector for connecting adjacent segments of a writing instrument in accordance with the present invention.
Figure 9B:
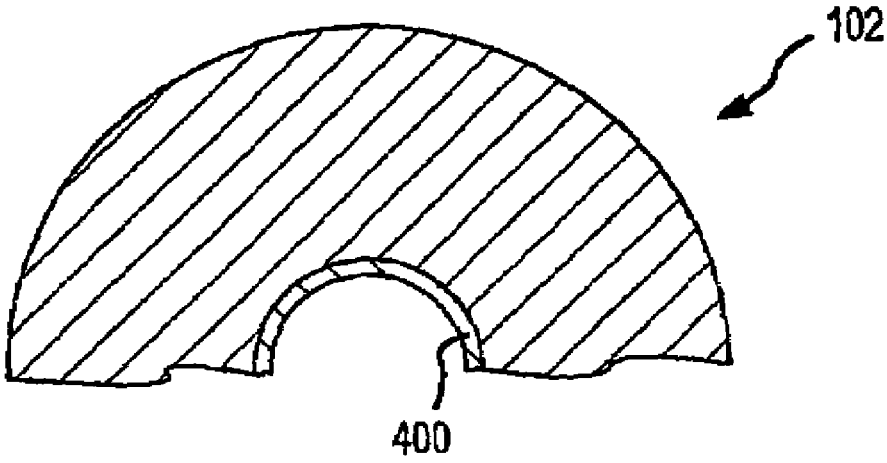
FIGS. 9B and 9C illustrate the cross sections of the second embodiment of a magnetic connector shown in FIG. 9A in accordance with the present invention.
Figure 9C:
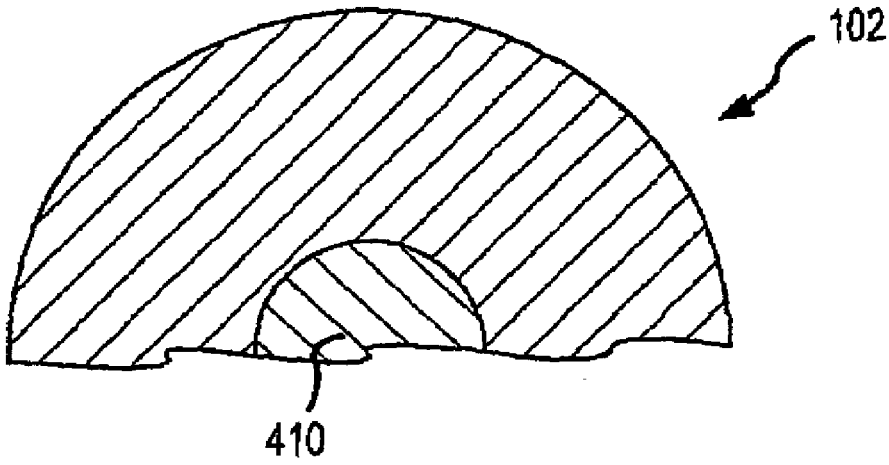
Figure 10:
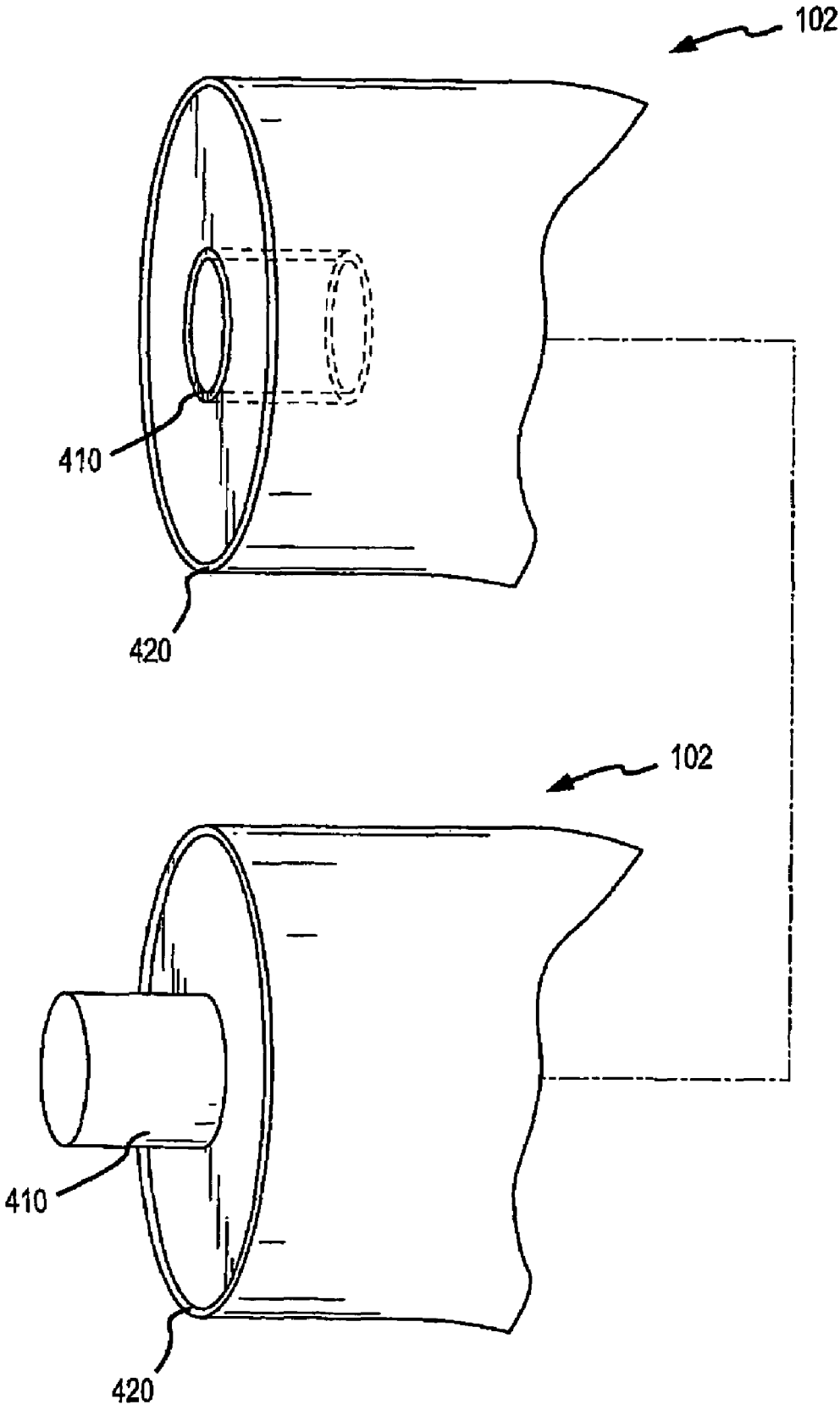

FIG. 9A illustrates a second embodiment of a magnetic connection for adjoining adjacent segments 102" of a writing instrument (including those having coatings) in accordance with one embodiment of the present invention. The magnetic connection of the second embodiment is also achieved using opposing pole magnets 400, 410. The first magnet is a cylindrical magnet 410 on a first end face of segment 102". The second magnet is a cylindrical central channel magnet 400 extending into the second end face of segment 102" for engaging cylindrical magnet 410 on the other one of the two adjacent segments for securing the plurality of segments together. FIGS. 9B and 9B illustrate the cross sections of the second embodiment of a magnetic connection shown in FIG. 9A.

Figure 10:
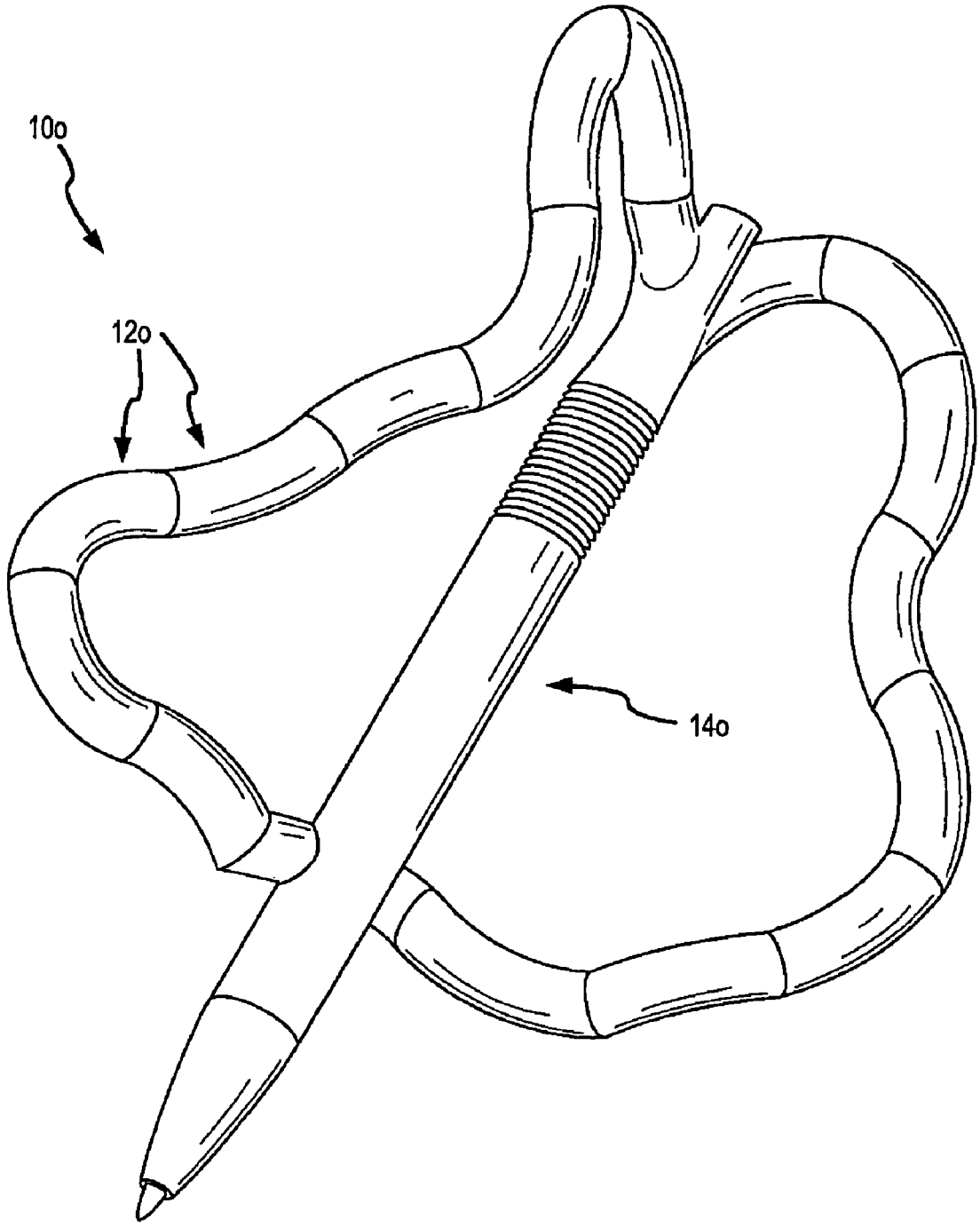
FIG. 10 is a magnetic connector with a textured coating applied to the outer surface of a segment in accordance with one embodiment of the present invention.

FIG. 10 is a magnetic connection using a cylindrical magnet 410*a* on a first end face of a segment 102*a* and a cylindrical central channel magnet 400*a* extending into the second end face of segment 102*a*. Segment 102*a* has a textured coating 420 applied to the outer surface of the segment. Textured coating may be a rubber, plastic, silicone gel, composite material or the like, however, those skilled in the art will understand that any coating may be used that is consistent with the properties of the above listed coatings. Further, any of the coatings described herein may be used with any of the segments 102', 102" or 102*a*.

Figure 11:
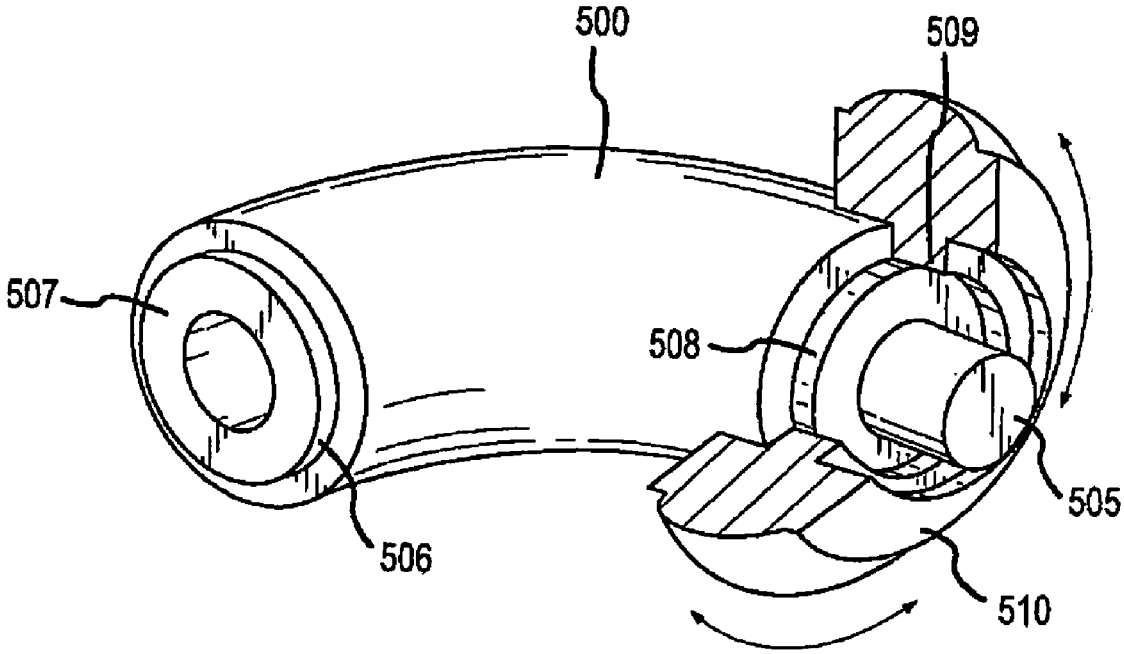
FIG. 11 illustrates a single segment of a writing instrument having a moveable element provided on the segment according to one embodiment of the present invention.

FIG. 11 illustrates an individual segment 500 having a rotatable element 510 disposed on the surface of segment 500 closest to a central extension-channel interface 505. A cooperating cylindrical central channel 507 of an adjacent segment receives central extension-channel interface 505 and secures rotatable element 510. A rotatable element rib 509 rests on central channel lip 507 and a central extension-channel lip 508 on an adjacent segment allowing rotation in a clockwise or counterclockwise direction about segment 500. Rotatable element 510 may be positioned at other locations on segment 500, and multiple elements 510 could be placed in the same segment. Also, some segments may include element 500 while others do not. In some cases, element 510 could be slid transversely along segment 500. Also, segment 500 as well as other segments described herein may be coupled to adjacent segments using a variety of different connections.

Figure 12:
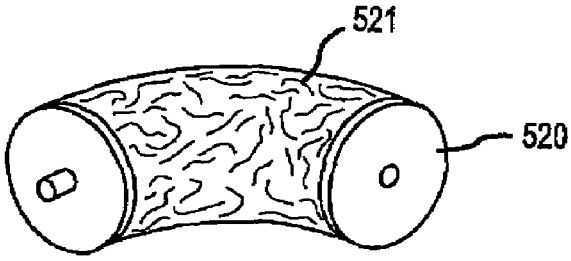
FIG. 12 illustrates a medicinal or ointment coating on a single segment of a writing instrument in accordance with one embodiment of the present invention.
Figure 13:
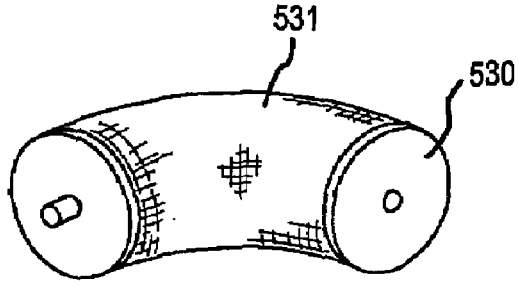
FIG. 13 illustrates a fabric coating on a single segment of a writing instrument in accordance with one embodiment of the present invention.
Figure 14:
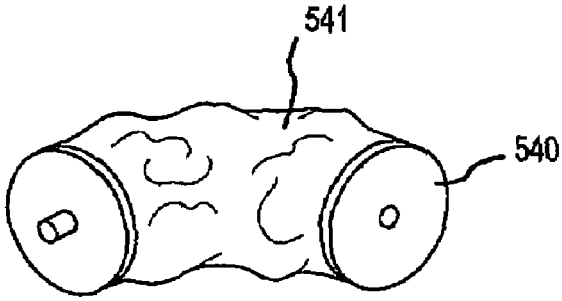
FIG. 14 illustrates a playdough coating on a single segment of a writing instrument in accordance with one embodiment of the present invention.
Figure 15:
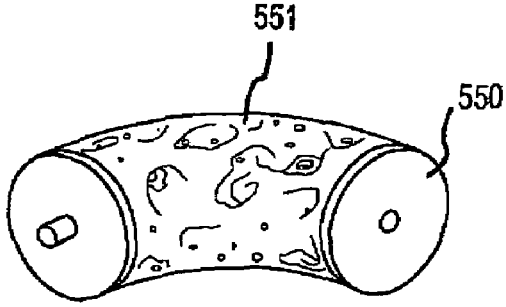
FIG. 15 illustrates a sponge coating on a single segment of a writing instrument in accordance with one embodiment of the present invention.

FIGS. 12-15 illustrate individual segments having a coating or covering disposed about the segment. FIG. 12 shows segment 520 having a medicine, ointment, cream, lubricant or similar content disposed on the surface. In operation, when the user handles the writing instrument, the contents from the surface are released onto the user's hands. FIG. 13 illustrates a segment 530 with a fabric coating 531. The fabric coating can be a material, mesh, cotton, wool, silk, fleece, spandex, linen, denim or similar material. The fabric coating 531 provides a unique sensation to the user's touch and increases the amount of time the user will operate the writing instrument. FIG. 14 illustrates a segment 540 with playdough 541 on the surface of the segment. Playdough 541 can be any malleable material such as putty, clay, or similar material. In operation, kids as well as adults will enjoy the soft, supple and pliable feature of the coating material, which translates into hours of enjoyment. FIG. 15 illustrates a segment 550 with a sponge covering 551. Sponge covering 551 may be any soft, springy and squishy covering such as foam or similar material. The distinctive nature of sponge covering 551 provides hours of pleasure to both adults and children.

Figure 16:
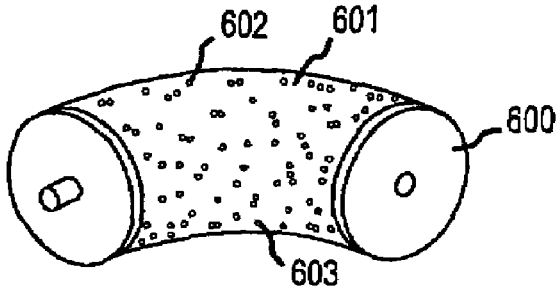
FIG. 16 illustrates a seeded coating on a single segment of a writing instrument in accordance with one embodiment of the present invention.
Figure 17:
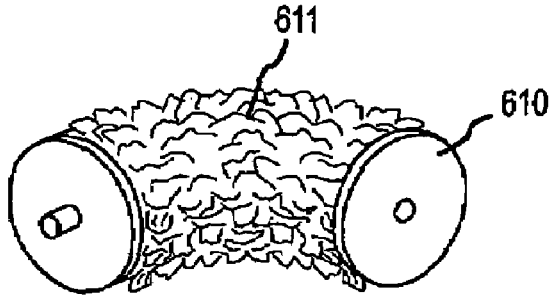
FIG. 17 illustrates a feather coating on a single segment of a writing instrument in accordance with one embodiment of the present invention.
Figure 18:
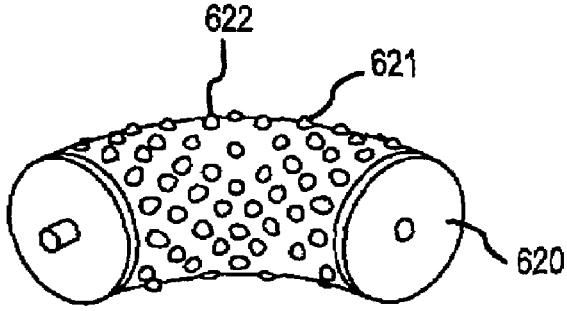
FIG. 18 illustrates a coating of spikes on a single segment of a writing instrument in accordance with one embodiment of the present invention.
Figure 19:
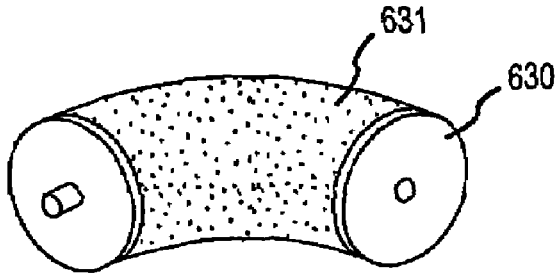
FIG. 19 illustrates a sandpaper coating on a single segment of a writing instrument in accordance with one embodiment of the present invention.

FIGS. 16-19 illustrate individual segments having a unique texture disposed on the surface of the segment. FIG. 16 shows segment 600 with a plurality of seeds 601, 602, 603 disposed on the surface of segment 600. FIG. 17 illustrates segment 610 having a surface of feathers 611. The feather texture coating 611 can also be manufactured of a natural fiber, a synthetic fiber, animal hair or similar texture. FIG. 18 shows segment 620 with a plurality of rubber spikes 621, 622 disposed on the surface. Rubber spikes 621, 622 may also be knobs, detents, bumps, ridges, ribs, bendable or flexible tabs, extensions, posts or similar textures. FIG. 19 illustrates segment 630 having a surface of sandpaper 631. Sandpaper texture 631 may also be manufactured of a texture having a rough, smooth, slippery, tacky, sticky, or lubricated sensation on the user's hands and fingers.

Figure 20:
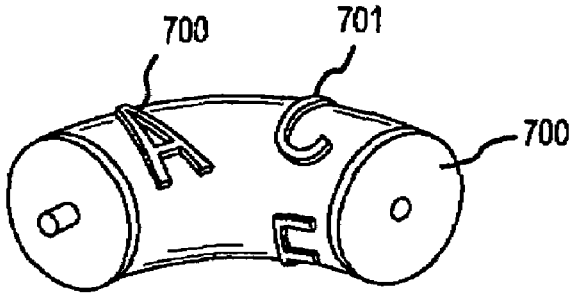
FIG. 20 illustrates a coating of raised characters on a single segment of a writing instrument in accordance with one embodiment of the present invention.
Figure 21:
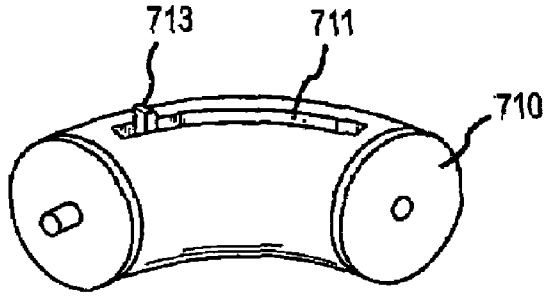
FIG. 21 illustrates a slidable tab integrated into and disposed on the surface of a single segment of a writing instrument in accordance with one embodiment of the present invention.
Figure 22:
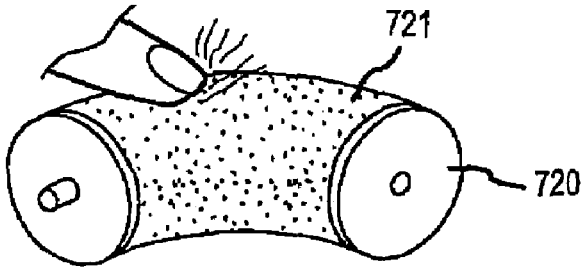
FIG. 22 illustrates a scratch and sniff coating on a single segment of a writing instrument in accordance with one embodiment of the present invention.
Figure 23:
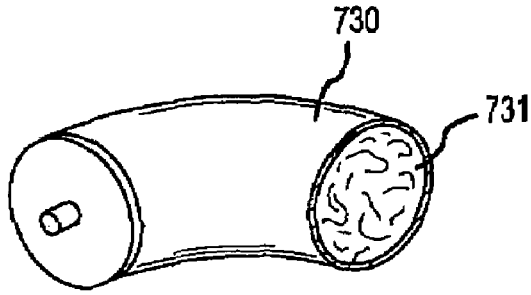
FIG. 23 illustrates a gel-filled single segment of a writing instrument in accordance with one embodiment of the present invention.

FIGS. 20-23 show several coatings, textures and segment properties on individual segments. FIG. 20 illustrates individual segment 700 having raised characters 701, 702. Raised characters 701, 702 may also be raised or recessed images, such as letters, characters, numbers, brail or the like. FIG. 21 shows an individual segment 710 having a slidable tab 713 operable in channel 711. FIG. 22 illustrates an individual segment 720 with a coating of a scratch and sniff element 721. Scratch and sniff element may also include scented materials useful in aromatherapy, such as herbs, flowers or even flavored substances. FIG. 23 illustrates an individual segment 730 having a gel filled center 731.

Figure 24:
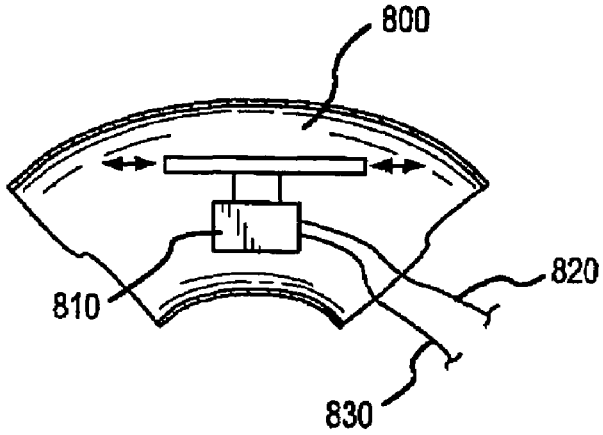
FIG. 24 illustrates a vibrating single segment of a writing instrument in accordance with one embodiment of the present invention.

FIG. 24 shows a cross section of individual segment 800 capable of providing a vibrating sensation to the user of the writing instrument manufactured from a plurality of segments 800. Segment 800 has a vibrating element 810 disposed beneath or on the surface of element 800 that provides a vibrating sensation to the surface of the element. Vibrating element 810 has a pair of leads 820, 830 that provide power to element 810. Leads 820, 830 may be coupled to a battery that is internal to the segment or a battery pack external to the segment. Leads 830, 840 may also be coupled in series or parallel with leads from other segments prior to coupling to the battery. Vibrating element 810 can be manufactured from any appropriate vibrating mechanism capable of providing vibration to the surface of a small segment 800, such as a piezoelectric vibrating mechanism, a mechanical vibrator or the like.

Figure 25:
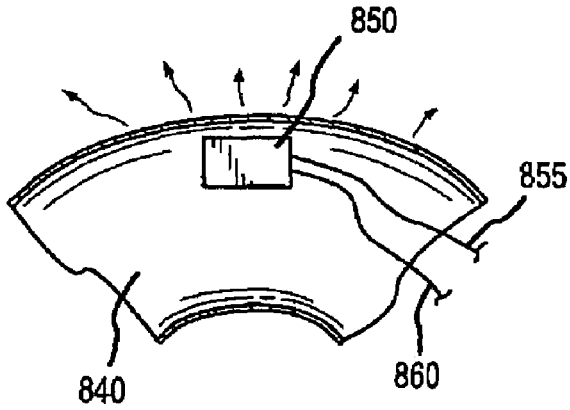
FIG. 25 illustrates a single segment having a heating/cooling device of a writing instrument in accordance with one embodiment of the present invention.

FIG. 25 illustrates a cross section of individual segment 840 capable of providing a heat or cold sensation to the surface of the segment and ultimately to the hand of the user of a writing instrument manufactured from a plurality of individual segments 840. Segment 840 has a heating and/or cooling element 850 disposed below or on the surface of element 840. Heating and/or cooling element 850 has a pair of leads 855, 860 that provide power to element 850. Leads 855, 860 may be coupled to a battery that is internal to the segment or a battery pack external to the segment. Leads 855, 860 may also be coupled in series or parallel with leads from other segments prior to coupling to the battery. Heating and/or cooling element 850 can be manufactured from any appropriate heating or cooling mechanism capable of providing a hot or cold sensation to the surface of a small segment 850, such as a Peltier device. Element 850 may also comprise a Peltier device that provides both a hot or cold sensation to the surface of segment 840, preferably by operation of a switch either on the surface of the writing instrument or on an external battery pack.

In the foregoing specification, the invention has been described with reference to a specific exemplary embodiment thereof. It will be evident that various modifications and changes may be made thereunto without departing from the broader spirit and scope of the invention as set forth in the appended claims. For example, various programming languages and techniques can be used to implement the disclosed invention. In addition, the specific logic presented to accomplish tasks within the present invention may be modified without departing from the scope of the invention. Many such changes or modifications will be readily apparent to one of ordinary skill in the art. The specification and drawings are, accordingly, to be regarded in an illustrative rather than a restrictive sense, the invention being limited only by the provided claims.

What is claimed is:

1. A writing instrument, comprising:

a writing instrument body having a first junction, a second junction, and a writing element; and a plurality of serially pivotally connected segments, the plurality of segments including at least a first segment and a second segment, wherein the segments are separate from the writing instrument body;

wherein the first junction is connected with the first segment and the second junction is connected with the second segment, wherein the first junction is disposed toward a first end of the writing instrument body, and wherein the second junction is disposed toward a second end of the writing instrument body, such that at least a portion of the writing instrument body is disposed between the first segment and the second segment.

2. The writing instrument of claim 1, wherein the first segment is disposed toward a first end of the plurality of pivotally connected segments.

3. The writing instrument of claim 2, wherein the second segment is disposed toward a second end of the plurality of pivotally connected segments.

4. The writing instrument of claim 1, wherein each of the plurality of serially pivotally connected segments is twistable relative to an adjacent segment through a 360 degree of rotation.

5. The writing instrument of claim 1, wherein each of the plurality of serially pivotally connected segments comprises a torus curve.

6. The writing instrument of claim 1, wherein each of the plurality of serially pivotally connected segments comprises a textured coating disposed on an outer surface thereof.

7. The writing instrument of claim 6, wherein the textured coating comprises a rubber coating, a rubber coating with raised nodules, a silicone gel coating, a chemical composite coating, or a compressible rubber coating.

8. The writing instrument of claim 1, wherein the first junction is releasably connected with the first segment and the second junction is releasably connected with the second segment.

9. A method of manufacturing a writing instrument, the method comprising:

coupling a writing element with a writing instrument body, the writing instrument body having a first junction and a second junction;

coupling a first segment of a plurality of serially pivotally connected segments to the first junction of the writing instrument body; and coupling a second segment of the plurality of serially pivotally connected segments to the second junction of the writing instrument body, wherein the plurality of connected segments is separate from the writing instrument body, wherein the first junction is disposed toward a first end of the writing instrument body, and wherein the second junction is disposed toward a second end of the writing instrument body.

10. The method of claim 9, wherein the first segment is disposed toward a first end of the plurality of pivotally connected segments.

11. The method of claim 10, wherein the second segment is disposed toward a second end of the plurality of pivotally connected segments.

12. The method of claim 9, wherein each of the plurality of serially pivotally connected segments is twistable relative to an adjacent segment through a 360 degree of rotation.

13. The method of claim 9, wherein each of the plurality of serially pivotally connected segments comprises a torus curve.

14. The method of claim 9, further comprising fixing a textured coating on an outer surface of each of the plurality of serially pivotally connected segments.

15. The method of claim 14, wherein the textured coating comprises a rubber coating, a rubber coating with raised nodules, a silicone gel coating, a chemical composite coating, or a compressible rubber coating.

16. The writing instrument of claim 9, comprising releasably connecting the first junction with the first segment and releasably connecting the second junction with the second segment.

17. A therapeutic writing instrument comprising:

a writing instrument body having a first junction, a second junction, and a writing element;

a plurality of serially pivotally connected segments, the plurality of segments including at least a first segment and a second segment; and a therapeutic element coupled with at least one of the plurality of segments to provide a therapeutic treatment to a user;

wherein the first junction of the writing instrument body is connected with the first segment and the second junction is connected with the second segment, such that the writing instrument body together with the plurality of serially pivotally connected segments form a ring, wherein the segments are separate from the writing instrument body, wherein the first junction is disposed toward a first end of the writing instrument body, and wherein the second junction is disposed toward a second end of the writing instrument body.

* * * * *

UNITED STATES PATENT AND TRADEMARK OFFICE

CERTIFICATE OF CORRECTION

PATENT NO. : 7,661,896 B2
APPLICATION NO. : 11/152020
DATED : February 16, 2010
INVENTOR(S) : Richard E. Zawitz It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 869 days.

Signed and Sealed this

Thirtieth Day of November, 2010

David J. Kappos

David J. Kappos
*Director of the United States Patent and Trademark Office*